US007427126B2

(12) United States Patent
Sugahara

(10) Patent No.: US 7,427,126 B2
(45) Date of Patent: Sep. 23, 2008

(54) LIQUID TRANSPORT DEVICE AND METHOD FOR MANUFACTURING LIQUID TRANSPORT DEVICE

(75) Inventor: Hiroto Sugahara, Ama-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 368 days.

(21) Appl. No.: 11/213,844

(22) Filed: Aug. 30, 2005

(65) Prior Publication Data

US 2006/0044361 A1 Mar. 2, 2006

(30) Foreign Application Priority Data

Aug. 31, 2004 (JP) ..... 2004-251304

(51) Int. Cl.
*B41J 2/045* (2006.01)

(52) U.S. Cl. ..... 347/70; 347/68

(58) Field of Classification Search ..... 347/68–72
See application file for complete search history.

(56) References Cited

U.S. PATENT DOCUMENTS 4,189,734 A * 2/1980 Kyser et al. ..... 347/70
5,802,686 A * 9/1998 Shimada et al. ..... 29/25.35
6,471,342 B1 10/2002 Horio et al.
2002/0080213 A1* 6/2002 Shimada et al. ..... 347/68
2005/0062802 A1* 3/2005 Kawamura ..... 347/50

FOREIGN PATENT DOCUMENTS

JP 8230182 9/1996
JP 2000-079683 3/2000
JP 2000289200 10/2000

* cited by examiner

*Primary Examiner*—Stephen D. Meier
*Assistant Examiner*—Geoffrey Mruk
(74) *Attorney, Agent, or Firm*—Banner & Witcoff, Ltd.

(57) ABSTRACT

A liquid transport device comprises a channel unit and a piezoelectric actuator. The channel unit has pressure chambers. The piezoelectric actuator changes the volume of the pressure chambers. The piezoelectric actuator consists mainly of a vibration plate, a piezoelectric layer and an anisotropic conductive layer, which is formed between the vibration plate and the piezoelectric layer. A portion of the anisotropic conductive layer is compressed to be conductive, and the other portion is insulative. The use of the anisotropic conductive layer makes the electric connection of the piezoelectric actuator simple in structure, increases the reliability of the connection and reduces the parasitic capacitance of the actuator.

12 Claims, 17 Drawing Sheets

LIQUID TRANSPORT DEVICE AND METHOD FOR MANUFACTURING LIQUID TRANSPORT DEVICE

FIELD OF THE INVENTION

The present invention relates to a liquid transport device. The invention also relates to a method for manufacturing a liquid transport device.

BACKGROUND OF THE INVENTION

A conventional ink jet head for discharging ink onto a recording medium to print an image or the like has a channel unit and a piezoelectric actuator unit. The channels which include nozzles and pressure chambers are formed in the channel unit. The actuator unit applies pressure on the ink in the pressure chambers. For example, Japanese Unexamined Patent Publication No. 8-230182 discloses an ink jet head including a head board and a piezoelectric actuator unit. The head board has pressure chambers formed in it. The actuator unit includes a vibration plate, a metallic conductive layer and piezoelectric elements. The vibration plate lies on the head board and covers the pressure chambers. The conductive layer is formed on the outer side of the vibration plate. Each of the piezoelectric elements is formed on the outer side of the conductive layer over one of the pressure chambers, with a terminal interposed between the piezoelectric element and the conductive layer. Another terminal is formed on the outer side of each of the piezoelectric elements. The terminals on the outer sides of the piezoelectric elements are connected to a flexible cable or another wiring means via an anisotropic conductive sheet. When voltage is applied to some of these terminals through the wiring means, electric fields act on the associated piezoelectric elements to deform them. The deformation of these piezoelectric elements results in the vibration plate being deformed to apply pressure on the ink in the associated pressure chambers.

Japanese Patent No. 3267937 (Corresponding to U.S. Pat. No. 6,471,342 B1) discloses an ink jet head including a head body (a channel unit) and a vibration plate as a common electrode. The head body has pressure chambers formed in it. The upper surface of the vibration plate is patterned with piezoelectric elements and individual electrodes. Each of the piezoelectric elements and each of the individual electrodes are positioned over one of the pressure chambers. Other piezoelectric elements are formed over the portions of the head body between adjacent pressure chambers. Wires (conductors) are formed on these piezoelectric elements. Drive voltage can be supplied through the wires to the individual electrodes. Electric contacts are concentrated at an end of the head body. This facilitates the wiring for the contacts and enables close arrangement of the pressure chambers.

In the ink jet head disclosed in Japanese Unexamined Patent Publication No. 8-230182, wires extend over the piezoelectric elements. Terminals of the wires are connected to the terminals on the outer sides of the piezoelectric elements. Accordingly, if external force is exerted on the wires, they are liable to come off the piezoelectric elements. This reduces the reliability of the electric connection between the terminal on the outer side of each of the piezoelectric elements and the associated wire. In order for this ink jet head to be small in size with its high-speed and high-quality printing performance maintained, its nozzles may be arranged densely. In this case, the pressure chambers, the piezoelectric elements and the terminals are arranged densely because each of the nozzles is associated with one of the pressure chambers, one of the piezoelectric elements and two of the terminals. The wires connected to the densely arranged terminals need to be spaced at narrow intervals. This raises the wire production cost.

In the ink jet head disclosed in Japanese Patent No. 3267937 (Corresponding to U.S. Pat. No. 6,471,342 B1) wires extend on the piezoelectric elements over the partition walls between adjacent pressure chambers. This results in the generation of undesired capacitance (parasitic capacitance) between the vibration plate as the common electrode and each of the wires. This also results in deformations of the piezoelectric layers over the partition walls. The deformations result in deformations of the piezoelectric layers over the pressure chambers, causing so-called crosstalk.

SUMMARY OF THE INVENTION

An object of the present invention is to provide a liquid transport device in which the electric connection for applying voltage to an electrode on a piezoelectric element is simple in structure and reliable. Another object of the invention is to provide a method for producing such a liquid transport device. Still another object of the invention is to provide a liquid transport device that is low in parasitic capacitance and a method for producing such a liquid transport device.

According to a first aspect of the present invention, a liquid transport device is provided that comprises a channel unit and a piezoelectric actuator. The channel unit has a plurality of pressure chambers arranged on a plane and a plurality of discharge ports for liquid each communicating with one of the pressure chambers. The piezoelectric actuator is arranged on a surface of the channel unit and changes the volume of the pressure chambers. The piezoelectric actuator has a vibration plate, wires, an anisotropic conductive layer, a piezoelectric layer and a first electrode. The vibration plate is insulative on at least one side thereof. The wires are disposed on the one side of the vibration plate, and each of which extends from a position facing one of the pressure chambers. The anisotropic conductive layer is formed on the one side of the vibration plate continuously over the pressure chambers. The anisotropic conductive layer is compressed to be conductive in first regions each facing one of the pressure chambers. The anisotropic conductive layer is insulative in a second region facing none of the pressure chambers. The piezoelectric layer is formed on a side of the anisotropic conductive layer that is opposite to the vibration plate. The first electrode is formed on the side of the piezoelectric layer that is opposite to the anisotropic conductive layer, continuously over the pressure chambers.

Because the wires extend on the vibration plate, they may extend in one direction. This simplifies the structure of the electric connection for causing electric fields to act on the portions of the piezoelectric layer each of which faces one of the pressure chambers. In addition, this improves the reliability of the connection. The anisotropic conductive layer, which lies on one side of the vibration plate, is conductive in the first regions, each of which faces the associated pressure chambers, and insulative in the second region. Drive voltage can be applied through the wires to the portions of the anisotropic conductive layer in the first regions so as to deform these portions. In the second region, the insulative portion of the anisotropic conductive layer lies between the first electrode and the wires so as to prevent the short-circuiting between this electrode and the wires. The intervening insulative portion of the anisotropic conductive layer inhibits the generation of parasitic capacitance in the piezoelectric layer between the first electrode and the wires. This makes it possible to drive the piezoelectric actuator at a lower voltage, thereby improving the driving efficiency of the actuator. It is also possible to inhibit the deformation of the piezoelectric layer in the second region, thereby reducing crosstalk.

The liquid transport device may be an ink jet head. The liquid may be ink, and the discharge ports may be nozzles through which the ink can be discharged. In this case, because the liquid transport device can transport a very small amount of liquid, it may be applied to an ink jet head for ejecting a very small amount of ink.

The piezoelectric actuator may further have second (individual) electrodes which are formed on the one side of the vibration plate to be connected to the respective wires, and each of which is at a position facing one of the pressure chambers. Because each of the second electrodes lies in the associated first region and is connected to the associated wire, it is possible to generate an electric field reliably across the piezoelectric layer through the wire and the second electrode.

The piezoelectric actuator may further have third electrodes which are formed between the piezoelectric layer and the anisotropic conductive layer, and each of which is disposed in one of the first regions. In this case, the third electrodes lie between the piezoelectric layer and the anisotropic conductive layer, each in the associated first region, which faces the associated pressure chamber. This makes it possible to generate an electric field reliably across the piezoelectric layer through the associated wire and third electrode.

The piezoelectric actuator may further have connecting terminals which are formed on the one side of the vibration plate, and each of which is being formed at an end of one of the wires. The terminals may be connected to a drive unit for supplying drive voltage to compressed conductive portions of the anisotropic conductive layer. This makes it possible to mount the drive unit on the vibration plate and connect this unit through the terminals and the wires to the portions of the anisotropic conductive layer each of which faces one of the pressure chambers. As a result, there is no need for a flexible printed wiring board (FPC) or another wiring means, so that the production cost can be reduced. Because the wires are formed by the screen printing process or the like directly on an insulating layer, which may lie on the vibration plate, they have no movable portion, and accordingly there is no possibility of their breaking.

The piezoelectric layer may include isolated piezoelectric portions and the piezoelectric portions may be formed only in the first regions. In this case, the piezoelectric portions lie only in the first regions, each of which faces the associated pressure chamber. This reliably prevents the generation of parasitic capacitance between each of the wires and the first (common) electrode in the second region, which does not face the pressure chambers. In this case, the piezoelectric layer does not deform in the second region, and no deformation of this layer propagates to its portions in the first regions, so that crosstalk can be reduced more reliably. The piezoelectric layer may be formed only in part of each of the first regions, for example a region facing each of the second electrodes.

The piezoelectric layer may be thicker in the first regions than in the second region. In this case, the piezoelectric layer is thicker in the first regions, each of which faces the associated pressure chamber, than in the second region. This enables the portions of the piezoelectric layer in the first regions to deform through the conductive portions of the anisotropic conductive layer, and prevents the portion of the piezoelectric layer in the second region from deforming through the insulative portion of the anisotropic conductive layer. In this case, the first electrode can be formed without differences in level on the piezoelectric layer, so that the formation can be simple.

The vibration plate may be thicker in the first regions than in the second region. In this case, the thicker portions of the vibration plate make it easy to plot the regions where the anisotropic conductive layer needs to be pressed to be conductive.

The sectional shape of the piezoelectric layer that is perpendicular to the plane thereof may be trapezoidal which becomes wider toward the vibration plate. The piezoelectric layer may have an overhang hanging on the side thereof opposite to the vibration plate in parallel with the plane of the piezoelectric layer. When pressure is applied on the upper surface of the piezoelectric layer to press the anisotropic conductive layer, the trapezoidal shape or the overhang prevents the part of the conductive layer that is squeezed from the gap between the piezoelectric layer and the vibration plate from rising along a side surface of the piezoelectric layer.

An ink jet printer according to the present invention may be provided with a liquid transport device as defined in the first aspect of the invention. In this case, because the liquid transport device is an ink jet head, it is possible to provide a printer fitted with a low-crosstalk ink jet head that has a piezoelectric actuator high in driving efficiency, and that is high in electric connection reliability.

The liquid transport device may further comprise a valve which regulates a flow of the liquid through it. The valve prevents the back flow of liquid, so that the liquid transport device can operate stably.

According to a second aspect of the present invention, a method is provided for producing a liquid transport device that comprises a channel unit and a piezoelectric actuator. The channel unit has a plurality of pressure chambers arranged on a plane and a plurality of discharge ports for liquid each communicating with one of the pressure chambers. The piezoelectric actuator is arranged on a surface of the channel unit and changes a volume of the pressure chambers. The method comprises: a vibration plate laminating step of arrangeing a vibration plate on the surface of the channel unit, the vibration plate being insulative on at least one side thereof; a wiring step of forming wires on the one side of the vibration plate, the wires each extending from a position facing one of the pressure chambers; an anisotropic conductive layer forming step of forming an anisotropic conductive layer on the one side of the vibration plate continuously over the pressure chambers; a piezoelectric layer forming step of forming a piezoelectric layer on the side of the anisotropic conductive layer that is opposite to the vibration plate; a compression step of pressing portions of the piezoelectric layer each of which faces one of the pressure chambers, relative to the vibration plate so as to compress portions of the anisotropic conductive layer each of which faces one of the pressure chambers; and the first electrode forming step of forming a first electrode on the side of the piezoelectric layer which is opposite to the anisotropic conductive layer, continuously over the pressure chambers.

The wires are formed on the vibration plate. This simplifies the structure of the electric connection for causing electric fields to act on the portions of the piezoelectric layer each of which faces one of the pressure chambers. In addition, this improves the reliability of the connection. The portion of the anisotropic conductive layer that faces each of the pressure chambers is pressed to be conductive, and the other portion of this layer is insulative, so that the short-circuiting between each of the wires and the first electrode is prevented. It is also possible to inhibit the generation of parasitic capacitance in the piezoelectric layer between each of the wires and the first electrode. This makes it possible to drive the piezoelectric actuator at a lower voltage, thereby improving the driving efficiency of the actuator.

The liquid transport device may be an ink jet head. The liquid may be ink. The discharge ports may be nozzles through which the ink is discharged. In the compression step, the portions of the piezoelectric layer each of which faces one of the pressure chambers may be pressed toward the vibration plate. This makes it possible to produce an ink jet head that is free of crosstalk, and that can drive its piezoelectric actuator efficiently at a low voltage.

In the wiring step, second electrodes may be formed, at positions facing the pressure chambers respectively, on the one side of the vibration plate to be connected to the wires respectively. This makes it possible to generate an electric field reliably across the piezoelectric layer through each of the wires and the associated second electrode.

In the wiring step, connecting terminals may be formed, at an end of one of the wires, on the one side of the vibration plate. The terminals may be connected to a drive unit for supplying drive voltage to the compressed conductive portions of the anisotropic conductive layer. This makes it possible to generate an electric field reliably across the piezoelectric layer through each of the wires and a third electrode.

In the piezoelectric layer forming step, the piezoelectric layer may include isolated piezoelectric portions, and the piezoelectric portions may be formed only in regions each facing one of the pressure chambers. This reliably inhibits the generation of undesired capacitance between each of the wires and the first electrode in a region facing none of the pressure chambers. This also inhibits the deformation of the piezoelectric layer in the region facing none of the pressure chambers. As a result, the crosstalk can be reduced.

In the compression step, the piezoelectric layer may be pressed while maintaining a state in which the piezoelectric portions formed in the regions each facing one of the pressure chambers protrudes from the anisotropic conductive layer. In this case, when a flat plate or the like presses piezoelectric layers at a time, it does not press the portion of the anisotropic conductive layer that faces none of the pressure chambers. In this case, part of the anisotropic conductive layer is prevented from rising onto the upper surfaces of the piezoelectric layers and sticking to them. This makes it possible to form the first electrode all over the upper surfaces of the piezoelectric layers.

A sectional shape of the piezoelectric layer which is perpendicular to its plane is trapezoidal which becomes wider toward the vibration plate. In the compression step, this makes it easy to form the first electrode on the side surfaces of the piezoelectric layer protruding from the anisotropic conductive layer.

The piezoelectric layer may have an overhang hanging on its side opposite to the vibration plate in parallel with the plane of this layer. When the piezoelectric layer is pressed, the overhang hinders part of the anisotropic conductive layer from rising onto the upper surface of the piezoelectric layer and sticking to it.

In the piezoelectric layer forming step, a liquid-repellent film may be formed on a side surface of the piezoelectric layer. This film makes the side surface of the piezoelectric layer less wet. As a result, when the piezoelectric layer is pressed, part of the anisotropic conductive layer is hindered from rising onto the upper surface of the piezoelectric layer and sticking to it.

In the vibration plate laminating step, a vibration plate which is thicker in regions each facing one of the pressure chambers than in other region may be used. The thicker portions of the vibration plate make it easy to plot the regions where the anisotropic conductive layer needs to be pressed to be conductive.

DETAILED DESCRIPTION OF PREFERRED EMBODIMENTS

Ink jet heads embodying the present invention will be described below with reference to the accompanying drawings.

First Embodiment

Figure 1:
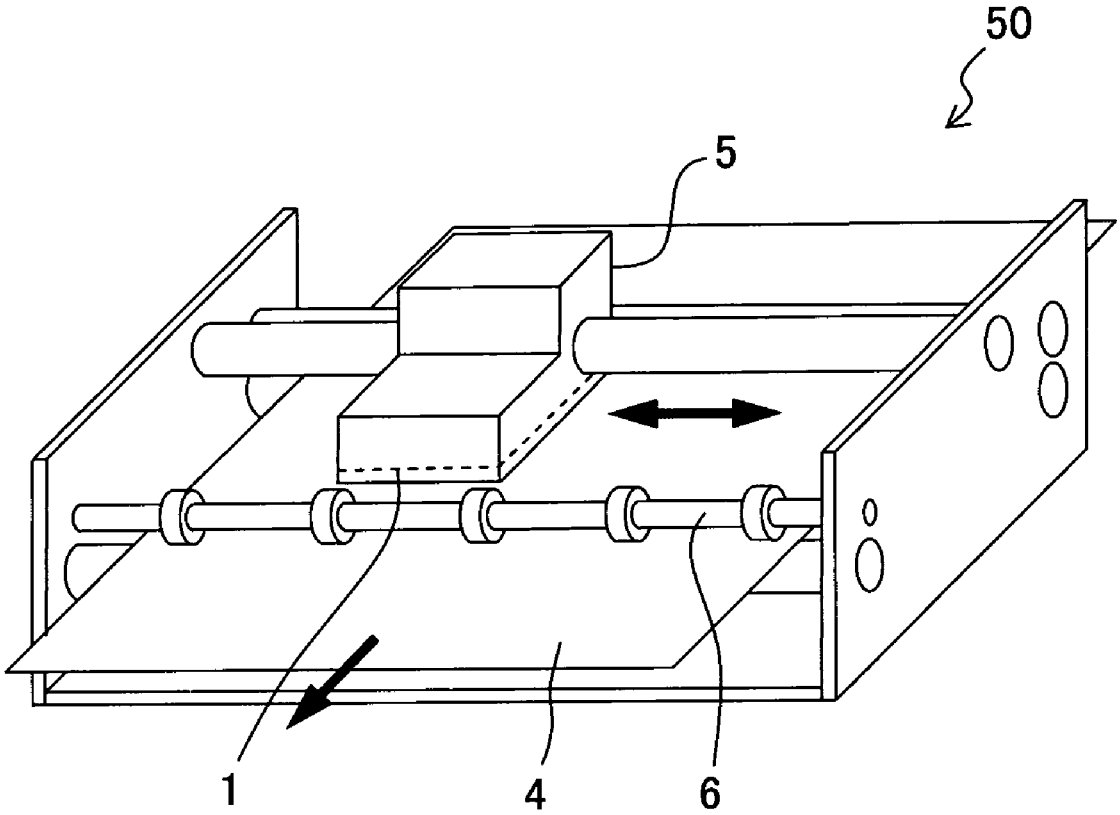
FIG. 1 is a mimetic diagram of a serial printer.
Figure 2:
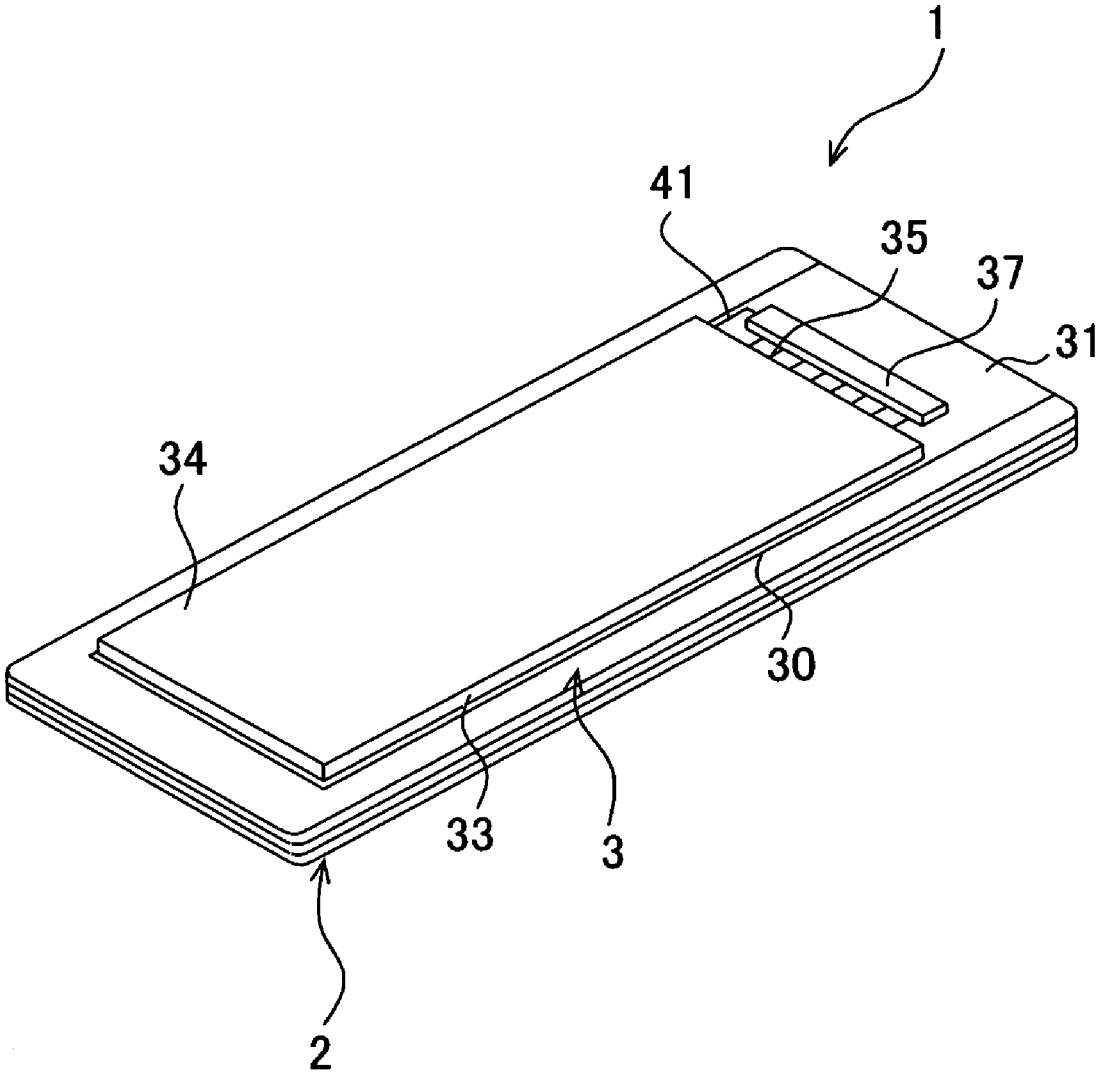
FIG. 2 is a perspective view of an ink jet head.

A first embodiment of the present invention will be described. FIG. 1 shows a serial printer 50, which has a carriage 5 and paper feed rollers 6. The carriage 5 reciprocates right and left in FIG. 1 and carries an ink jet head 1 on its bottom. The feed rollers 6 feed paper 4 in the direction indicated by an arrow in FIG. 1. The ink jet head 1 discharges ink onto the paper 4. As shown in FIG. 2, the ink jet head 1 includes a channel unit 2 and a piezoelectric actuator 3. The channel unit 2 has ink channels formed in it. The piezoelectric actuator 3 lies on the top side of the channel unit 2.

The channel unit 2 will be described first. As shown in FIGS. 3-6, the channel unit 2 includes a cavity plate 10, a base plate 11, a manifold plate 12 and a nozzle plate 13, which are bonded together in the form of a laminate. The cavity plate 10, base plate 11 and manifold plate 12 are substantially rectangular plates of stainless steel, through which ink channels can be etched easily. The ink channels include a manifold 17 and pressure chambers 14, which will be described later on. The nozzle plate 13 may be formed of polyimide or another polymeric synthetic resin and is bonded to the under surface of the manifold plate 12. Alternatively, the nozzle plate 13 may be formed of stainless steel or another metallic material, as is the case with the other three plates 10-12.

Figure 3:
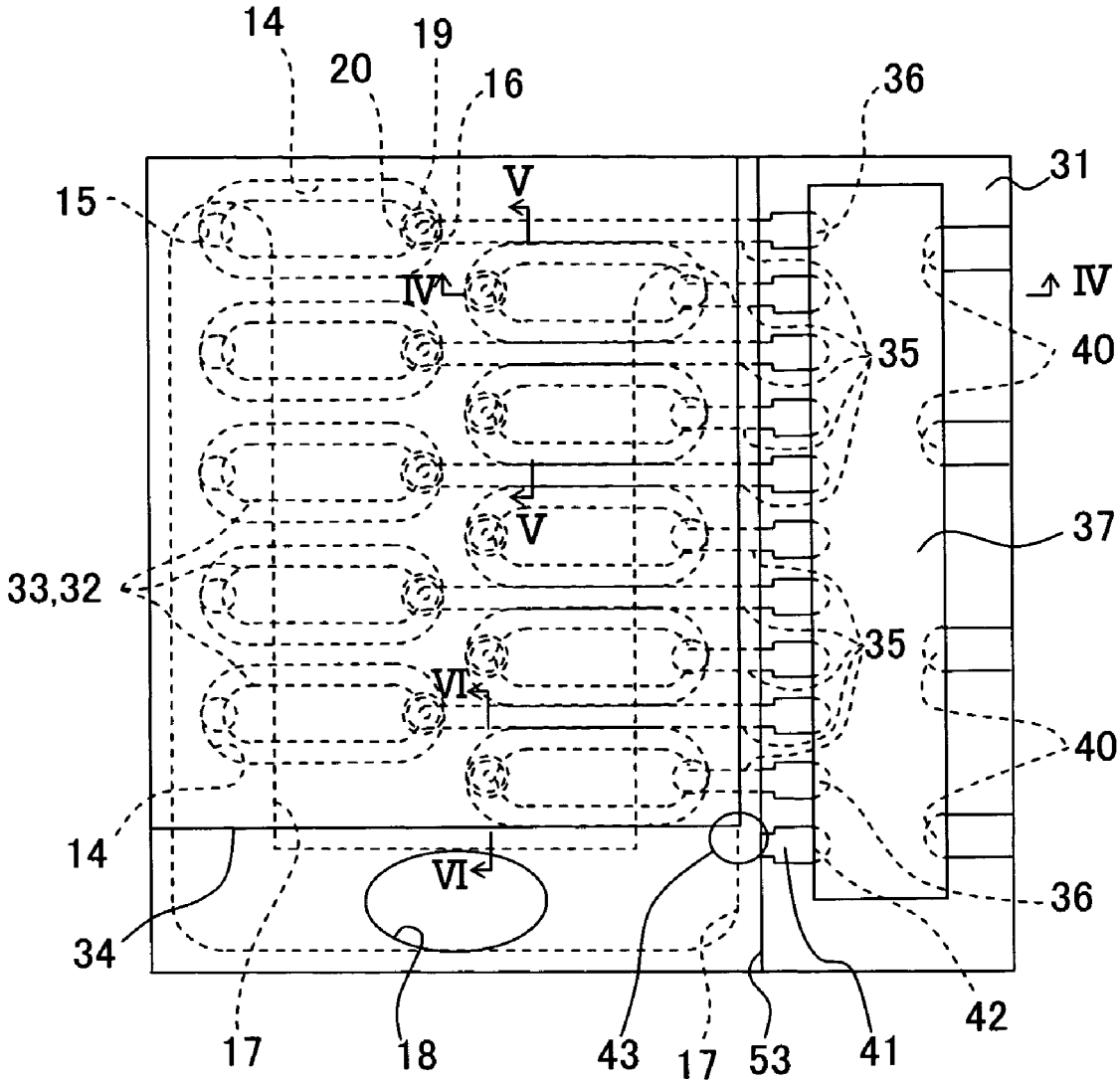
FIG. 3 is a schematic plan view of the right half of the ink jet head shown in FIG. 2.

As shown in FIG. 3, the cavity plate 10 has a number of pressure chambers 14 arrayed on a plane. The pressure chambers 14 are open on the top side of the channel unit 2 (the upper surface of the cavity plate 10). A vibration plate 30, which will be described later on, is bonded to the upper surface of the cavity plate 10. In FIG. 3, some (ten) of the pressure chambers 14 are shown. The pressure chambers 14 are substantially elliptic in plan view and extend in parallel with the longer sides of the cavity plate 10.

The base plate 11 has communicating holes 15 and 16 formed through it, which are aligned with the ends of the pressure chambers 14 in plan view. The manifold plate 12 has a manifold 17 formed through it, which includes two portions extending in parallel with the shorter sides of the manifold plate 12 (up and down in FIG. 3). In plan view, these portions of the manifold 17 overlap with the pressure chambers 14, which are shown in FIG. 3. The cavity plate 10 also has an ink supply port 18 formed through it, through which ink is supplied from an ink tank (not shown) to the manifold 17. The manifold plate 12 also has communicating holes 19 formed through it. In plan view, the communicating holes 19 are aligned with the ends of the pressure chambers 14 that are adjacent to the supply port 18 in FIG. 3. The nozzle plate 13 has nozzles 20 formed through it. In plan view, the nozzles 20 are aligned with the ends of the pressure chambers 14 that are adjacent to the supply port 18 in FIG. 3. The nozzles 20 may be formed through a substrate of polyimide or another polymeric synthetic resin by means of excimer laser processing.

Figure 4:
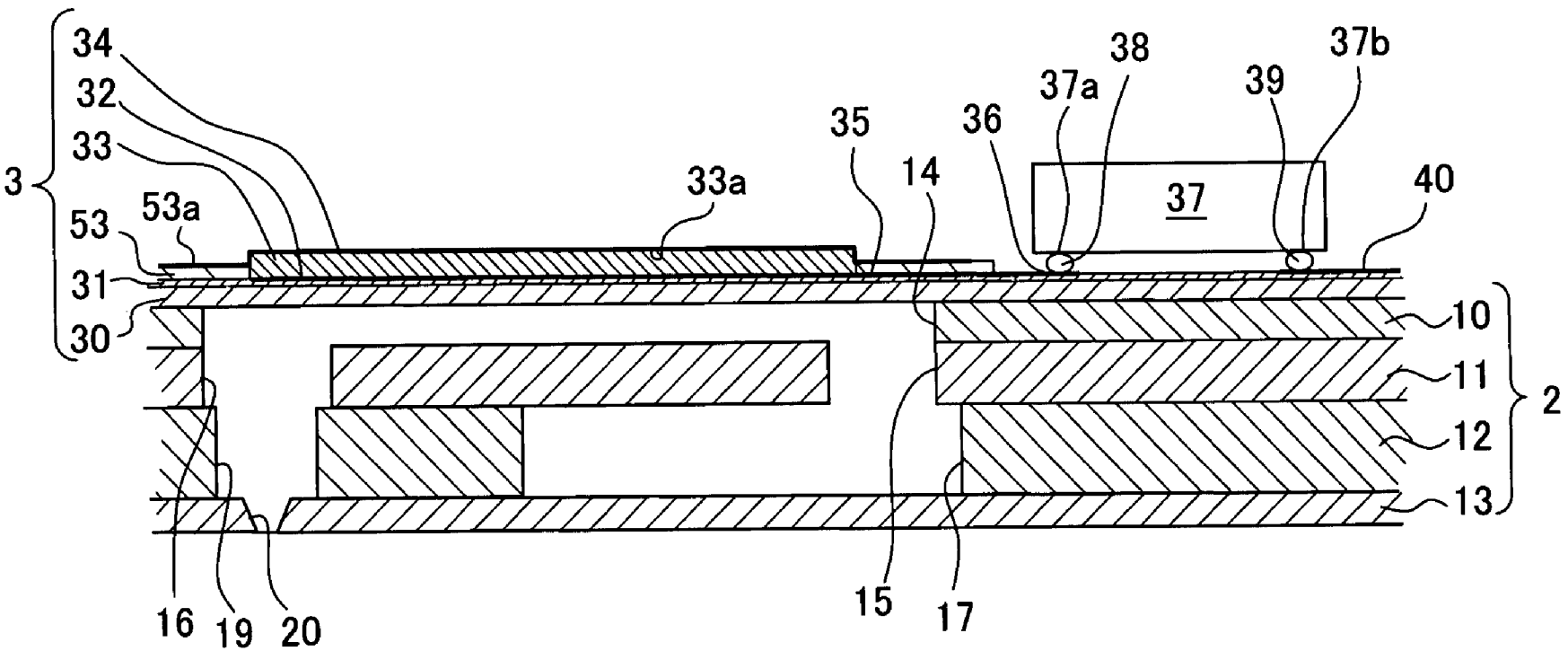
FIG. 4 is a sectional view taken along line IV-IV of FIG. 3.

As shown in FIG. 4, the manifold 17 communicates through the communicating holes 15 with the pressure chambers 14, which communicate through the communicating holes 16 and 19 with the nozzles 20. Thus, ink channels are formed in the channel unit 2 and extend from the manifold 17 through the pressure chambers 14 to the nozzles 20.

The piezoelectric actuator 3 will be described below. As shown in FIGS. 2-6, the piezoelectric actuator 3 includes a vibration plate 30, an insulating layer 31, individual electrodes (second electrodes) 32, an anisotropic conductive layer 53, piezoelectric layers 33 and a common electrode (a first electrode) 34. The vibration plate 30 is positioned on the top side of the channel unit 2. The insulating layer 31 is formed on the upper surface of the vibration plate 30. The individual electrodes 32 are formed on the upper surface of the insulating layer 31, and each of them is associated with one of the pressure chambers 14. The anisotropic conductive layer 53 is formed on the upper surface of the insulating layer 31, on which the individual electrodes 32 are formed, continuously over the pressure chambers 14. The piezoelectric layers 33 are formed on the anisotropic conductive layer 53 each over one of the pressure chambers 14. The common electrode 34 is formed continuously on the upper surfaces 33*a* of the piezoelectric layers 33 and the upper surface 53*a* of the portion of the anisotropic conductive layer 53 where the piezoelectric layers do not lie. The common electrode 34 extends over the individual electrodes 32 and is common to them.

The vibration plate 30 is a plate of stainless steel, which is substantially rectangular in plan view. The vibration plate 30 lies on and is bonded to the upper surface of the cavity plate 10, closing the tops of the pressure chambers 14. The vibration plate 30 is formed of stainless steel having a relatively high coefficient of elasticity. Accordingly, the high rigidity of the vibration plate 30 makes the piezoelectric actuator 3 highly responsive when the piezoelectric layers 33 deform to discharge ink, as will be stated later on. The vibration plate 30 is bonded to the upper surface of the cavity plate 10, which is formed of stainless steel. Accordingly, the vibration plate 30 and cavity plate 10 have the same coefficient of thermal expansion, which improves their bonding strength. The ink in the channel unit 2 comes into contact with the vibration plate 30 and channel unit 2, which are formed of stainless steel. Because stainless steel is high in corrosion resistance against ink, any type of ink forms no local cell in the channel unit 2 or on the vibration plate 30. Accordingly, the selection of ink is not limited by corrosion, so that the degree of freedom of ink selection is great.

The insulating layer 31 lies on the upper surface of the vibration plate 30. The upper surface of the insulating layer 31 is flat. The insulating layer 31 is formed of alumina, zirconia, silicon nitride or another ceramic material having a high coefficient of elasticity. The insulating layer 31 may be formed by the aerosol deposition (AD) process, sol-gel process, CVD process or sputtering process. Because the insulating layer 31 is formed of a ceramic material having a high coefficient of elasticity, the actuator is more rigid and more responsive. Because the insulating layer 31 lies on the upper surface of the vibration plate 30, the individual electrodes 32 can be formed over the vibration plate 30 through the insulating layer 31 even though the vibration plate 30 is formed of stainless steel, which is the suitable material, not an insulating material.

The individual electrodes 32 are formed on the upper surface of the insulating layer 31 by means of screen printing or the like. The individual electrodes 32 are elliptic in plan view and one size smaller than the pressure chambers 14. Each individual electrode 32 lies over a central portion of the associated pressure chamber 14 in plan view. The individual electrodes 32 are formed of gold or another electrically conductive material. Adjoining individual electrodes 32 are insulated electrically from each other by the insulating layer 31.

A wire 35 extends from one end (the right end in FIG. 3) of each individual electrode 32 and in parallel with the major axis of the ellipse of the individual electrodes 32 on the upper surface of the insulating layer 31. A terminal 36 is formed at the end of each wire 35 that is away from the associated individual electrode 32. The terminals 36 for the individual electrodes 32 are positioned at the same level. A driver IC (a driver) 37 is mounted on the upper surface of the insulating layer 31 and supplies a drive voltage selectively to the individual electrodes 32. The driver IC 37 has output terminals 37*a*, which are connected to the terminals 36 for the individual electrodes 32 through bumps 38 formed of solder or another electrically conductive brazing material. Thus, the wires 35, which extend on the same plane as the individual electrodes 32 extend, can connect these electrodes and the driver IC 37 directly without using an FPC or another costly wiring means. This reduces the cost of electric connection and increases the reliability of electric connection.

The driver IC 37 also has input terminals 37*b*. Connecting terminals 40 are formed on the upper surface of the insulating layer 31. Each connecting terminal 40 is connected to one of the input terminals 37*b* through a bump 39, which may be formed of solder. This enables the driver IC 37 and the controller (not shown) for controlling it to be connected easily via the connecting terminals 40.

The anisotropic conductive layer 53 lies on the upper surface of the insulating layer 31, on which the individual electrodes 32 lie. The anisotropic conductive layer 53 is made of an anisotropic conductive film (ACF). This film is a sealing resin that is a thermosetting epoxy resin in which electrically conductive particles are dispersed. The anisotropic conductive layer 53 is formed as a layer continuing over all of the portions of the insulating layer 31 each of which lies over one of the pressure chambers 14. These portions of the insulating layer 31 include the portions of this layer each of which lies under one of the individual electrodes 32. The anisotropic conductive layer 53 may be formed by either transferring an ACF onto the upper surface of the insulating layer 31, or transferring ACFs successively without spaces between them onto this side. Alternatively, the anisotropic conductive layer 53 may be formed by coating the upper surface of the insulating layer 31 uniformly with an anisotropic conductive paste (ACP).

Each piezoelectric layer 33 lies on the upper surface of the anisotropic conductive layer 53 over the associated individual electrode 32. The principal component of the piezoelectric layers 33 is lead zirconate titanate (PZT), which is a ferroelectric solid solution of lead titanate and lead zirconate. In this embodiment, each piezoelectric layer 33 extends only in the region over the associated individual electrode 32, which is part of the region over the associated pressure chamber 14. Thus, the region where each piezoelectric layer 33 lies may be part (the region over the associated electrode 32) of the region over the associated pressure chamber 14. Needless to say, each piezoelectric layer 33 may extend over the whole region over the associated pressure chamber 14. The piezoelectric layers 33 are formed by cutting a piezoelectric sheet into pieces of suitable size with a laser. The piezoelectric sheet is formed by burning a green sheet at about 1,100 degrees C. While the upper surfaces 33*a* of the piezoelectric layers 33 are heated, these layers are pressed toward the insulating layer 31 so as to be transferred onto the anisotropic conductive layer 53. The heating and pressing of each piezoelectric layer 33 compress the portion of the anisotropic conductive layer 53 that lies between it and the insulating layer 31, thereby compressing the electrically conductive particles in this portion. In other words, part of the portion of the anisotropic conductive layer 53 that lies over each of the pressure chambers 14 is compressed. The compressed conductive particles come into contact with each other and are pressed against the individual electrodes 32 and piezoelectric layers 33, so that each of these electrodes is connected electrically to the associated piezoelectric layer. Thus, the portion of the anisotropic conductive layer 53 that lies between each of the piezoelectric layers 33 and the insulating layer 31 is electrically conductive. The heated and pressed anisotropic conductive layer 53 is hardened in a compressed state. The other portion of the anisotropic conductive layer 53, which does not lie on the individual electrodes 32, is not compressed during the heating, so that the conductive particles in this portion are out of contact with each other. Accordingly, this layer portion is electrically insulative and naturally hardened. The piezoelectric layers 33 are fixed with their upper surfaces 33*a* positioned above the upper surface 53*a* of the portion of the anisotropic conductive layer 53 where the piezoelectric layers do not lie. Thus, the portions of the anisotropic conductive layer 53 that are compressed by being heated and pressed are electrically conductive, so that each individual electrode 32 is connected electrically to the associated piezoelectric layers 33. Accordingly, in order to discharge ink, as will be stated later on, it is possible to deform the piezoelectric layers 33 by applying an electric field to them. The piezoelectric layers 33 lie only over the individual electrodes 32. Accordingly, the deformation of one or more of the piezoelectric layers 33 does not result in the adjacent piezoelectric layers 33 being deformed. This makes it possible to reliably reduce crosstalk.

Figure 5:
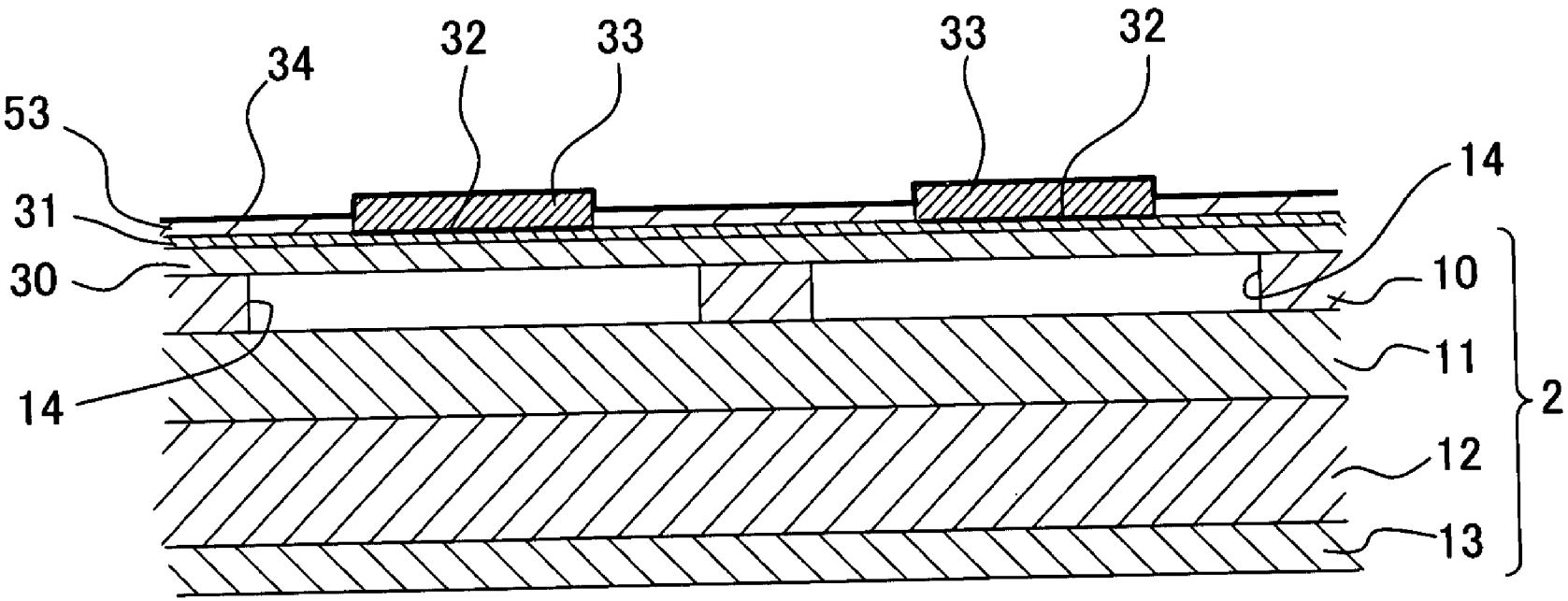
FIG. 5 is a sectional view taken along line V-V of FIG. 3, being a sectional view of an ink jet head according to a first embodiment of the present invention.
Figure 6:
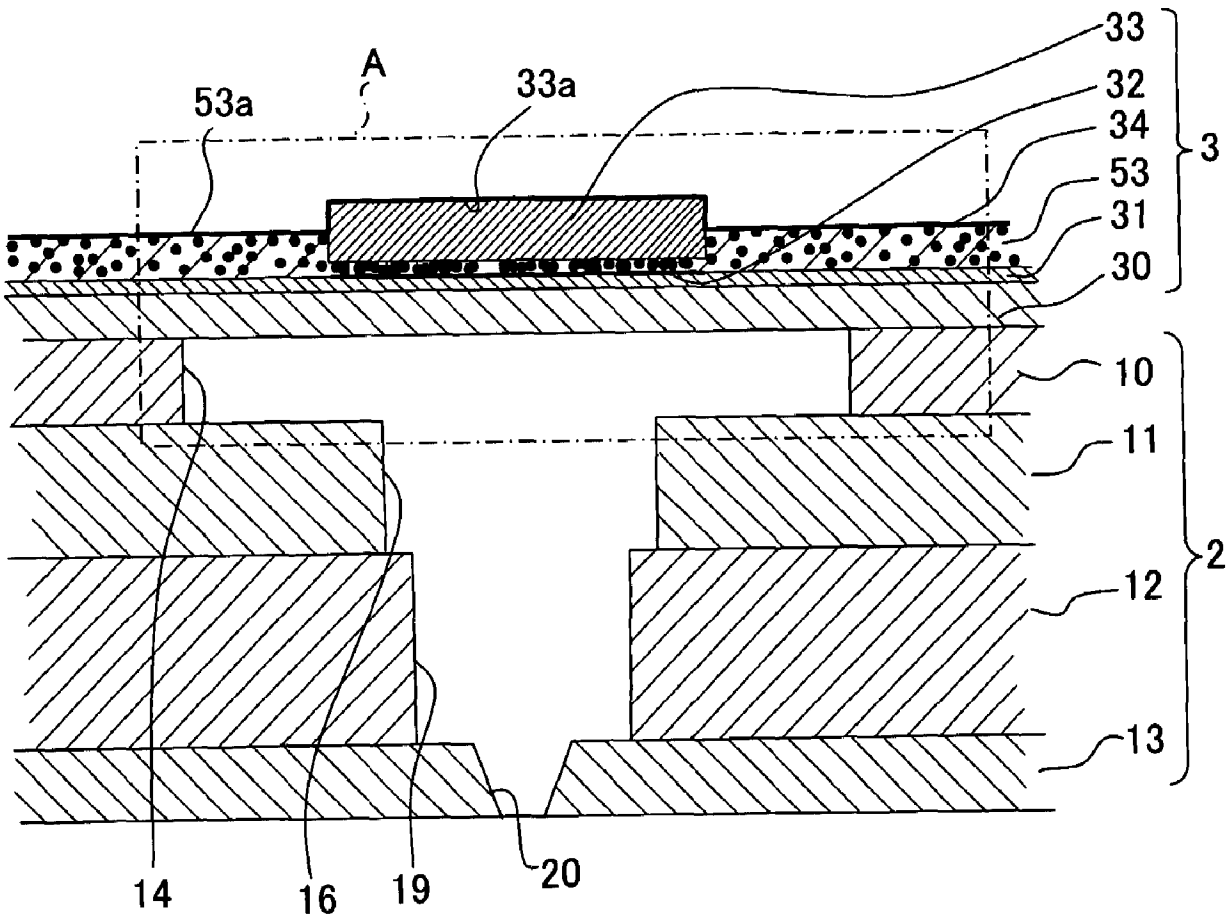
FIG. 6 is a sectional view taken along line VI-VI of FIG. 3, being a sectional view of the ink jet head according to the first embodiment.

As shown in FIGS. 4-6, the common electrode 34, which is common to the individual electrodes 32, is formed continuously with differences in level on the upper surfaces 33*a* of the piezoelectric layers 33 and the upper surface 53*a* of the portion of the anisotropic conductive layer 53 where the piezoelectric layers 33 do not lie. As shown in FIG. 3, one end of a wire 41 is connected to the common electrode 34. The wire 41 extends on the upper surface of the insulating layer 31. A terminal 42 is formed at the other end of the wire 41 and connected to a terminal (not shown) of the driver IC 37. This results in the common electrode 34 being grounded through the wire 41 and driver IC 37 to be kept at ground potential. The common electrode 34, also, is formed of gold or another electrically conductive material. The common electrode 34, wire 41 and terminal 42 may be formed by the screen printing process, vapor deposition process or sputtering process. The terminals 42 and 36 are positioned at the same level. The insulating portion of the anisotropic conductive layer 53 lies between the thus formed common electrode 34 and the wires 35, so that the common electrode 34 and wires 35 are not short-circuited. When voltage is applied to the wires 35, no parasitic capacitance is generated between the common electrode 34 and wires 35. This improves the driving efficiency of the piezoelectric actuator 3.

Because the common electrode 34 lies over all the individual electrodes 32, it can be connected to the driver IC 37 by only one wire 41. Accordingly, there is no need to use an FPC or another special wiring means for connecting the common electrode 34 to the driver IC 37. Because the common electrode 34 has only one terminal, it is easy to connect the common electrode 34 electrically by means of conductive paste or the like, and the connection is reliable.

With reference to FIG. 3, the terminals 36 for the individual electrodes 32 and the terminal 42 for the common electrode 34 lie on the upper surface of the insulating layer 31 so that all these terminals 36 and 42 can be positioned at the same level. This makes it easy to join the output terminals of the driver IC 37 to the terminals 36 and 42, and increases the reliability of the electric connection between the joined terminals. The formation of all the terminals 36 and 42 on the upper surface of the insulating layer 31 merely requires that the wires 35 and 41 be formed on this side. This makes it possible to position the terminals 36 and 42 at the same level by means of a simple wiring structure without through holes or the like.

If the wire 41 is formed at a time from the common electrode 34 to the insulating layer 31, the portion of this wire at the difference in level is thin. In this case, as shown in FIG. 3, the thin portion can be more reliable with a reinforcement 43.

With reference to FIG. 4, a description will be provided below of how the ink jet head 1 operates when it discharges ink. When drive voltage is supplied from the driver IC 37 selectively to some of the individual electrodes 32, each of which is connected to the driver IC 37 via the associated wire 35, the individual electrodes 32 under the piezoelectric layers 33 to which the voltage is supplied are different in potential from the common electrode 34 over the piezoelectric layers, which is kept at ground potential. The potential difference generates a vertical electric field across the piezoelectric layer 33 between the common electrode 34 and each of the individual electrodes 32 to which the voltage is applied. The electric field contracts a portion of the associated piezoelectric layer 33 horizontally (perpendicularly to the vertical direction of polarization), which lies just above the individual electrode 32 to which the driving voltage is applied. The insulating layer 31 and vibration plate 30, which lie under the piezoelectric layers 33, are fixed to the cavity plate 10. Accordingly, a portion of the piezoelectric layer 33 between the common electrode 34 and each of the individual electrodes 32 to which the voltage is applied deforms convexly toward the associated pressure chamber 14. As a result of the partial deformation of the piezoelectric layer 33, the portion of the vibration plate 30 that covers the pressure chamber 14 deforms convexly into the chamber. This reduces the volume of the pressure chamber 14 to raise the ink pressure in it, thereby discharging ink from the nozzle 20 communicating with the chamber.

With reference to FIGS. 7A-7F, a description will be provided below of a method for producing the ink jet head 1. FIGS. 7A-7F are enlarged views of a main part A of FIG. 6, which are sectional views showing in order of the production steps of a process for producing the ink jet head 1. First, the three stainless steel plates 10-12 are joined together by means of diffused junction or the like.

Diaphragm Laminating Step

Figure 7A:
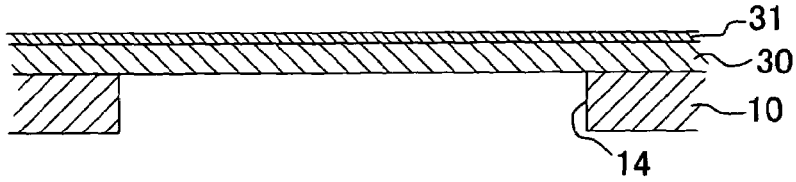
FIGS. 7A-7F are enlarged views of a main part A of FIG. 6, being sectional views showing in order of production the steps of a process for producing an ink jet head.

With reference to FIG. 7A, the vibration plate 30 is so joined to the upper surface of the cavity plate 10 by means of diffused junction or the like as to close the tops of the pressure chambers 14. The insulating layer 31 is formed continuously on the upper surface of the vibration plate 30. The insulating layer 31 is made of alumina, zirconia, silicon nitride or another ceramic material. The insulating layer 31 may be formed by the aerosol deposition (AD) process, which causes ultra fine particles to collide at high speed and deposit. This process makes it possible to form a very thin and dense layer. The insulating layer 31 may also be formed by the sol-gel process, sputtering process or CVD process.

Wiring Step

Figure 7B:
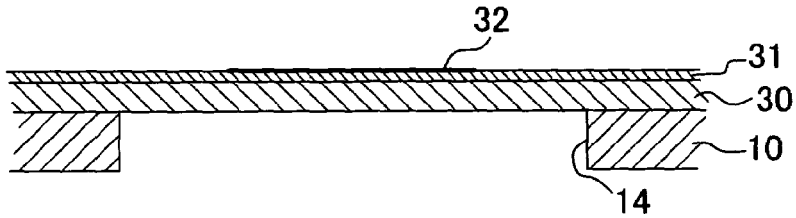

With reference to FIG. 7B, each individual electrode 32 is formed by means of screen printing on the upper surface of the insulating layer 31 over the central portion of the associated pressure chamber 14. At the same time that the individual electrodes 32 are formed, the wires 35 and 41 and terminals 36, 40 and 42 (FIGS. 3 and 4) are formed by means of screen printing. The wires 35 extend perpendicularly to FIGS. 7A-7F. The terminals 36 are ends of the wires 35 and connected to bumps of the driver IC 37. The connecting terminals 40 are joined to the input terminals 37*b* of the driver IC 37. The common electrode 34 is connected to the driver IC 37 via the wire 41 and terminal 42. For example, it is possible to pattern the upper surface of the insulating layer 31 with the individual electrodes 32, wires 35 and 41 and terminals 36, 40 and 42 at a time by screen-printing a conductive paste on this side. Alternatively, it is possible to pattern the upper surface of the insulating layer 31 with the individual electrodes 32, wires 35 and 41 and terminals 36, 40 and 42 by forming an electrically conductive layer on the whole area of the insulating layer 31 by the plating process, sputtering process, vapor deposition process or the like, and by removing part of the formed conductive layer by means of a laser, a mask, the resist process or the like.

Anisotropic Conductive Layer Forming Step

Figure 7C:
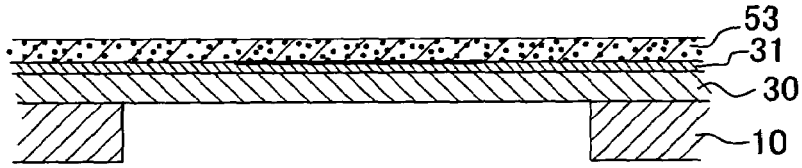

With reference to FIG. 7C, the anisotropic conductive layer 53 is formed on the upper surface of the insulating layer 31. The anisotropic conductive layer 53 is a single layer continuing over all the regions on the insulating layer 31 each of which lies over one of the pressure chambers 14. These regions are inclusive of the regions where the individual electrodes 32 lie. The anisotropic conductive layer 53 may be formed by transferring an ACF onto the upper surface of the insulating layer 31, alternatively transferring ACFs successively without spaces between them onto this side, or coating this side uniformly with an ACP. The individual electrodes 32 and wires 35 lie between the insulating layer 31 and anisotropic conductive layer 53. Because the terminals 36 lie off the anisotropic conductive layer 53, they can be connected via the bumps 38 to the driver IC 37, which is mounted on the upper surface of the insulating layer 31. The terminals 40 and 42 and wire 41, also, are not covered by the anisotropic conductive layer 53.

Piezoelectric Layer Forming Step

Figure 7D:
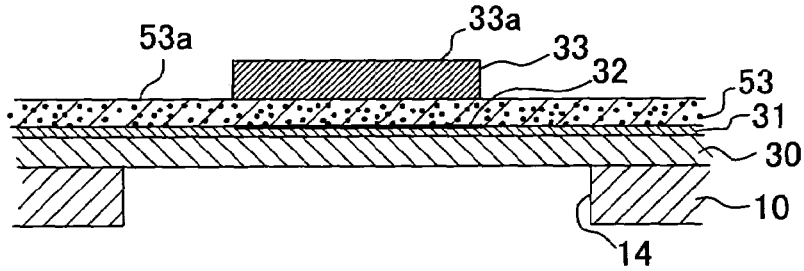

With reference to FIG. 7D, each piezoelectric layer 33 is transferred onto the upper surface of the anisotropic conductive layer 53 over the associated individual electrode 32. The piezoelectric layers 33 are formed by cutting a piezoelectric sheet into pieces of predetermined size with a laser. The piezoelectric sheet is formed by burning a green sheet of PZT.

Compression Step

Figure 7E:
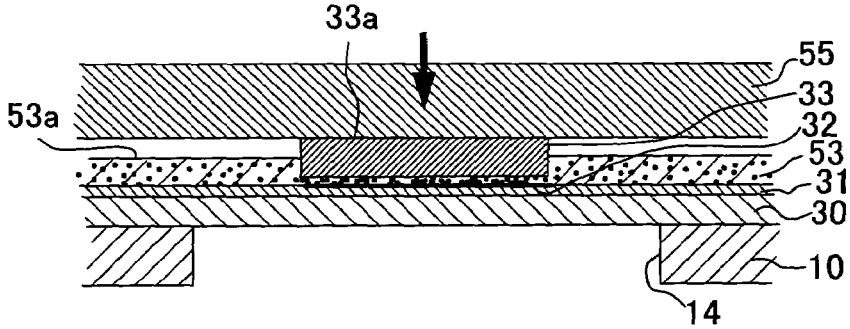

With reference to FIG. 7E, a pressing plate 55 comes into compressive contact with the upper surfaces 33*a* of the piezoelectric layers 33 to press these layers toward the insulating layer 31 while the layers are heated. During the pressing of the layers, a state in which the piezoelectric layers 33 are protruded from the anisotropic conductive layer 53 is maintained. Each piezoelectric layer 33 lies in the region over the associated pressure chamber 14 (the region over the associated individual electrode 32). The pressing of the piezoelectric layers 33 compresses the portion of the anisotropic conductive layer 53 that lies between each piezoelectric layer 33 and the associated individual electrode 32. As a result, the conductive particles in the compressed portions of the anisotropic conductive layer 53 are compressed. The compressed conductive particles connect each piezoelectric layer 33 to the associated individual electrodes 32. The heated and pressed anisotropic conductive layer 53 hardens. The pressed piezoelectric layers 33 are fixed with their upper surfaces 33*a* positioned above the anisotropic conductive layer 53. Thus, the piezoelectric layers 33 are pressed with their upper surfaces 33*a* positioned above the upper surface 53*a* of the portion of the anisotropic conductive layer 53 where the individual electrodes 32 do not lie. Accordingly, this portion of the anisotropic conductive layer 53 is not pressed. This prevents part of the anisotropic conductive layer 53 from rising onto the upper surfaces 33*a* of the piezoelectric layers 33 and sticking to it. This portion of the anisotropic conductive layer 53 hardens naturally, keeping insulative. This portion of the anisotropic conductive layer 53 may be heated to harden quickly.

First Electrode Forming Step

Figure 7F:
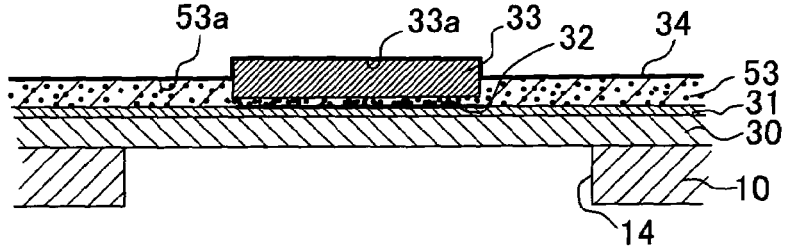

With reference to FIG. 7F, the common electrode 34, which is common to the individual electrodes 32, is formed continuously with differences in level on the upper surfaces 33*a* of the piezoelectric layers 33 and the upper surface 53*a* of the portion of the anisotropic conductive layer 53 where the piezoelectric layers 33 do not lie. The common electrode 34 may be formed by the screen printing process, vapor deposition process or sputtering process.

Subsequently, as shown in FIG. 4, the driver IC 37 is mounted on the upper surface of the insulating layer 31. Each output terminal 37*a* of the driver IC 37 is connected via the associated bump 38 to the associated terminal 36 or 42. Each input terminal 37*b* of the driver IC 37 is connected via the associated bump 39 to the associated connecting terminal 40. Finally, the nozzle plate 13 is bonded to the under surface of the manifold plate 12.

As described above, each individual electrode 32 is formed on the upper surface of the insulating layer 31 over the associated pressure chamber 14. Each piezoelectric layer 33 is formed on the upper surface of the anisotropic conductive layer 53 over the associated individual electrode 32. The piezoelectric layers 33 are heated and pressed so that the portion of the anisotropic conductive layer 53 that lies on each individual electrode 32 is compressed to be conductive. The portion of the anisotropic conductive layer 53 that does not lie on the individual electrodes 32 is not compressed and is insulative. Accordingly, in the regions over the pressure chambers 14 (more specifically the individual electrodes 32), the potential difference between each of the individual electrodes 32 to which drive voltage is applied and the common electrode 34 can deform the piezoelectric layer 33 lying between the individual electrode 32 and common electrode 34. In the region that does not lie over the pressure chambers 14 (more specifically the individual electrodes 32), it is possible to inhibit the generation of parasitic capacitance between the common electrode 34 and each of the wires 35, which extend on the insulating layer 31. This makes it possible to improve the driving efficiency of the piezoelectric actuator 3. The anisotropic conductive layer 53, which has an insulating characteristic, prevents each wire 35 and the common electrode 34 from short-circuiting. In the region that does not lie over the pressure chambers 14, no piezoelectric layer 33 lies, so that no deformation occurs. This makes it possible to reduce the crosstalk that occurs in the piezoelectric layers 33, which lie over the pressure chambers 14.

It is possible to connect the individual electrodes 32 and the driver IC 37 directly via the wires 35, which extend on the same plane (on the insulating layer 31) as these electrodes lie, without using an FPC or another costly wiring means. This makes it possible to reduce the cost of electric connection and increase the reliability of electric connection.

The upper surfaces 33*a* of the piezoelectric layers 33 are positioned above the anisotropic conductive layer 53. This prevents the portion of the anisotropic conductive layer 53 that does not lie over the pressure chambers 14 from being pressed to be conductive. This also prevents part of the anisotropic conductive layer 53 from rising onto the upper surfaces 33*a* of the piezoelectric layers 33 and sticking to them. Accordingly, the common electrode 34 can be formed wholly.

The sequence of steps performed in this embodiment is not limited to that shown in it. The wiring step might be followed by the vibration plate laminating step. The wiring step, the anisotropic conductive layer forming step and the piezoelectric layer forming step might be followed by the vibration plate laminating step.

Second Embodiment

Figure 8:
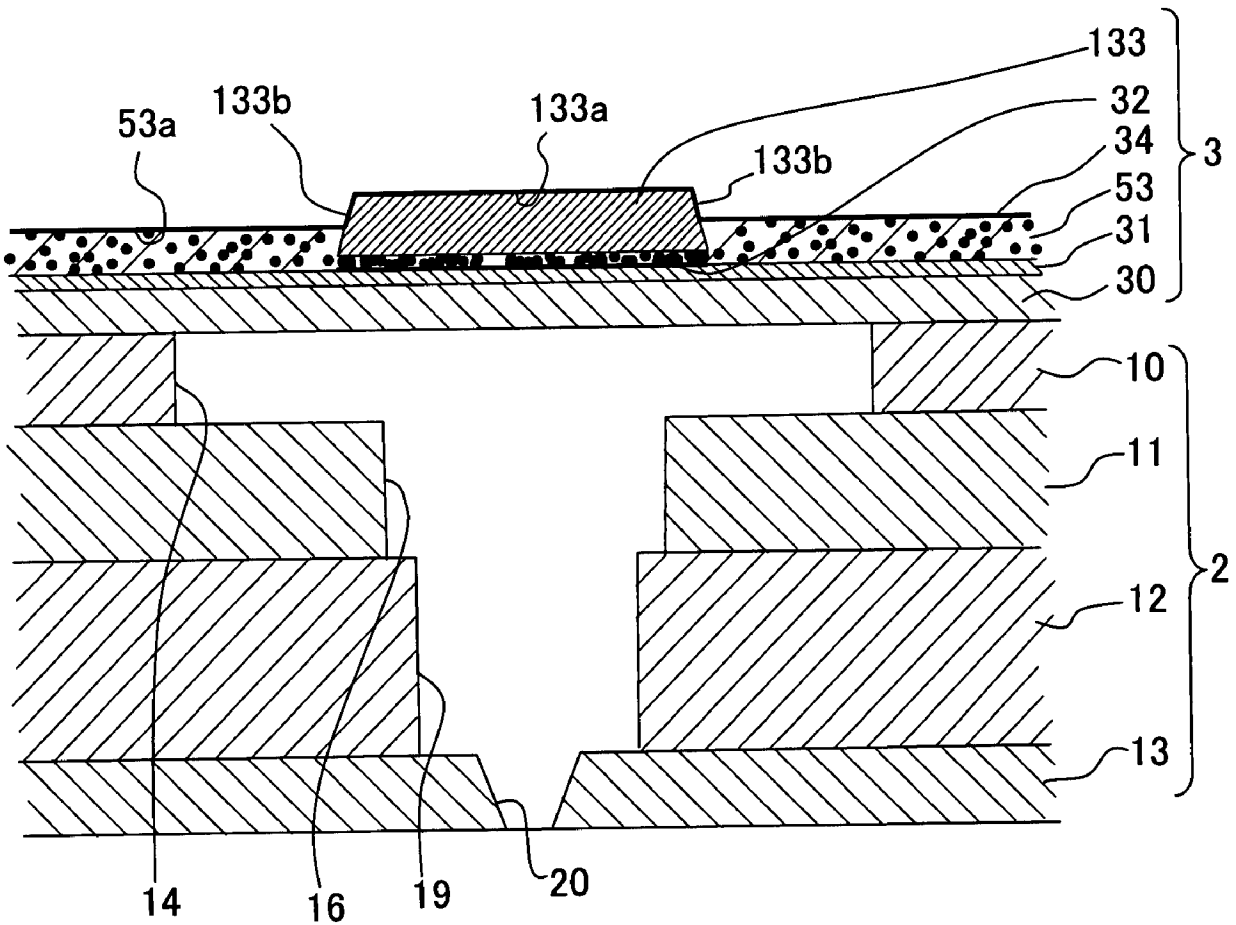
FIG. 8 is a sectional view similar to FIG. 6, being a sectional view of an ink jet head according to a second embodiment of the present invention.

A second embodiment of the present invention will be described below with reference to FIG. 8. The parts in this embodiment that are identical with the counterparts in the first embodiment will be assigned the same reference numerals and will not be described. FIG. 8 is a sectional view similar to FIG. 6. This embodiment differs in structure from the first embodiment in that each piezoelectric layer 133 of this embodiment is trapezoidal and wider toward the vibration plate 30 (downward) in vertical section. The upper surface 133*a* of each piezoelectric layer 133 is positioned above the upper surface 53*a* of the portion of the anisotropic conductive layer 53 that does not lie on the individual electrodes 32. The side surfaces 133*b* of each piezoelectric layer 133 are inclined. This makes it easy to form the common electrode 34 continuously with differences in level on the upper surface 53*a* of the anisotropic conductive layer 53 and the upper surfaces 133*a* and side surfaces 133*b* of the piezoelectric layers 133 in the first electrode forming step described in connection with the first embodiment. The other aspects of the structure, operation and effect of this embodiment are the same as those of the first embodiment and will not be described.

Third Embodiment

Figure 9:
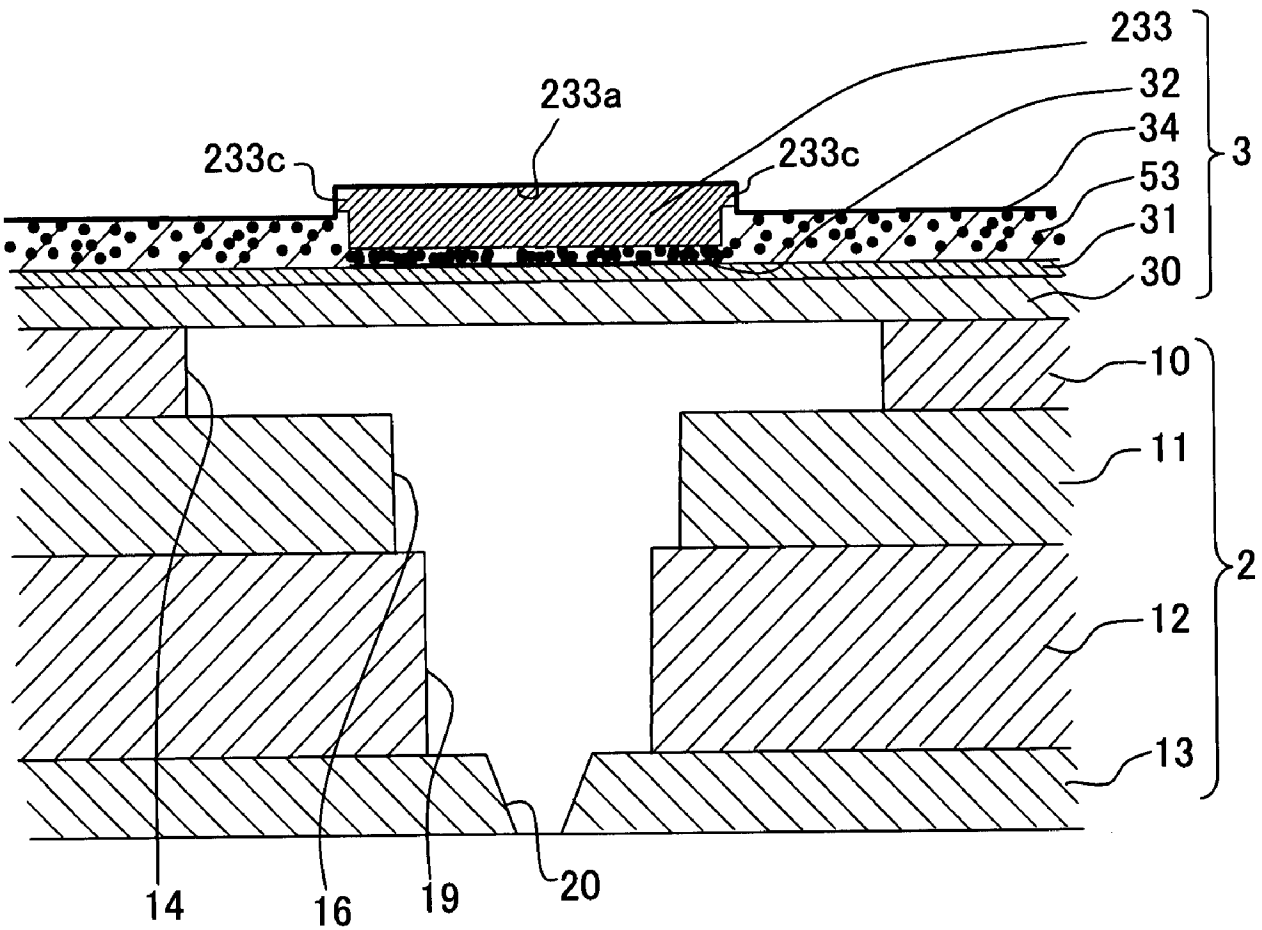
FIG. 9 is a sectional view similar to FIG. 6, being a sectional view of an ink jet head according to a third embodiment of the present invention.

A third embodiment of the present invention will be described below with reference to FIG. 9. The parts in this embodiment that are identical with the counterparts in the first embodiment will be assigned the same reference numerals and will not be described. FIG. 9 is a sectional view similar to FIG. 6. This embodiment differs in structure from the first embodiment in that each piezoelectric layer 233 of this embodiment has overhangs 233*c* hanging horizontally from both sides of its top. When the piezoelectric layers 233 are heated and pressed in the compression step described in connection with the first embodiment, the overhangs 233*c* hinder part of the anisotropic conductive layer 53 from rising onto the upper surfaces 233*a* of the piezoelectric layers 233 and sticking to them. The other aspects of the structure, operation and effect of this embodiment are the same as those of the first embodiment and will not be described.

Fourth Embodiment

Figure 10:
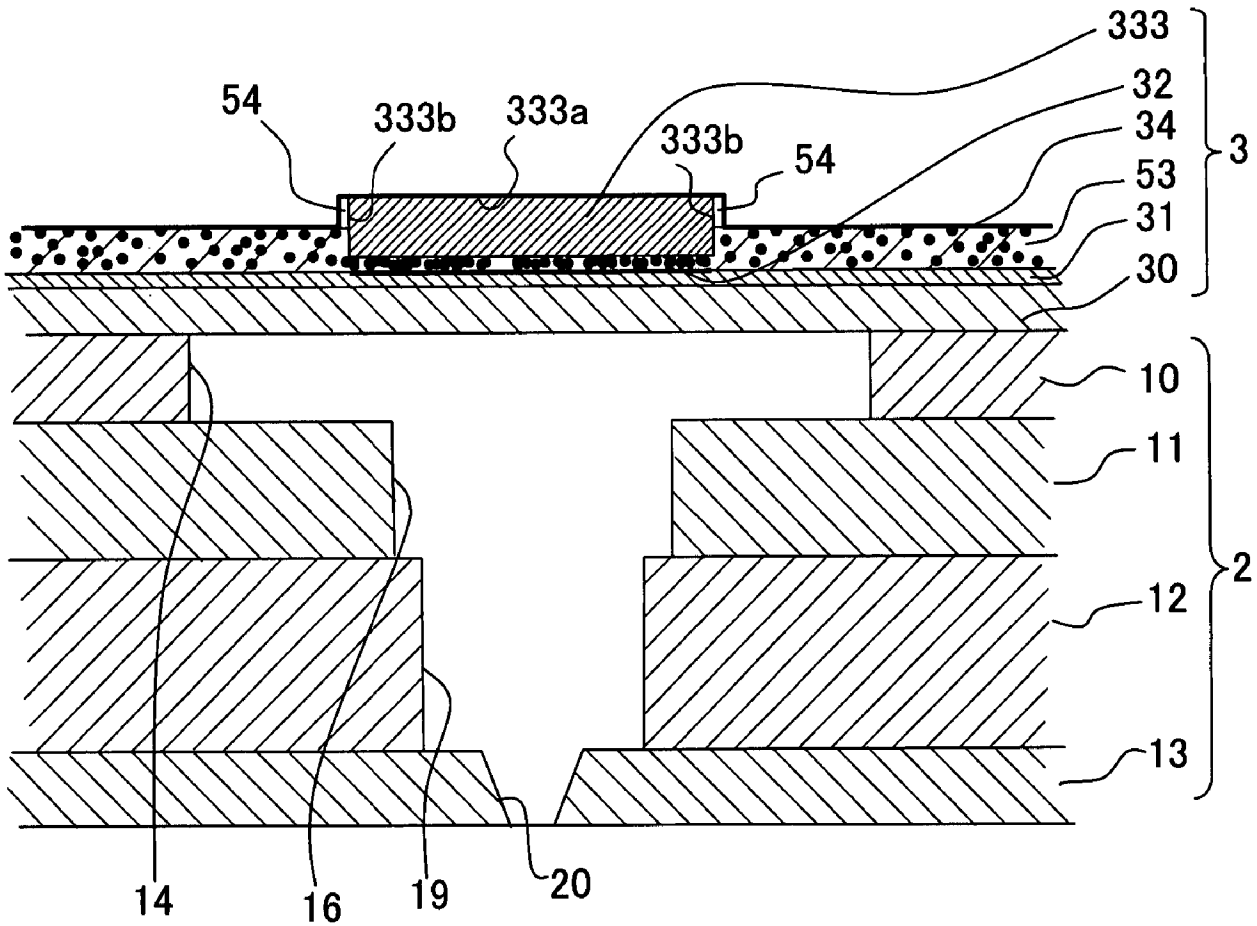
FIG. 10 is a sectional view similar to FIG. 6, being a sectional view of an ink jet head according to a fourth embodiment of the present invention.

A fourth embodiment of the present invention will be described below with reference to FIG. 10. The parts in this embodiment that are identical with the counterparts in the first embodiment will be assigned the same reference numerals and will not be described. FIG. 10 is a sectional view similar to FIG. 6. This embodiment differs in structure from the first embodiment in that each piezoelectric layer 333 of this embodiment has water-repellent films 54 formed on its side surfaces 333*b*. The water-repellent films 54 are formed by means of sticking, coating or the like on the side surfaces 333*b* of the piezoelectric layers 333 at the previous stage of transferring the piezoelectric layers 333, which are formed by burning a piezoelectric sheet and cutting the burned sheet with a laser, onto the anisotropic conductive layer 53 in the piezoelectric layer forming step described in connection with the first embodiment. When the piezoelectric layers 333 are heated and pressed in the compression step described in connection with the first embodiment, the water-repellent films 54 on their side surfaces 333*b* repel the anisotropic conductive layer 53 in contact with the films, hindering part of the anisotropic conductive layer 53 from rising onto the upper surfaces 333*a* of the piezoelectric layers 333 and sticking to them. The other aspects of the structure, operation and effect of this embodiment are the same as those of the first embodiment and will not be described.

Fifth Embodiment

Figure 11:
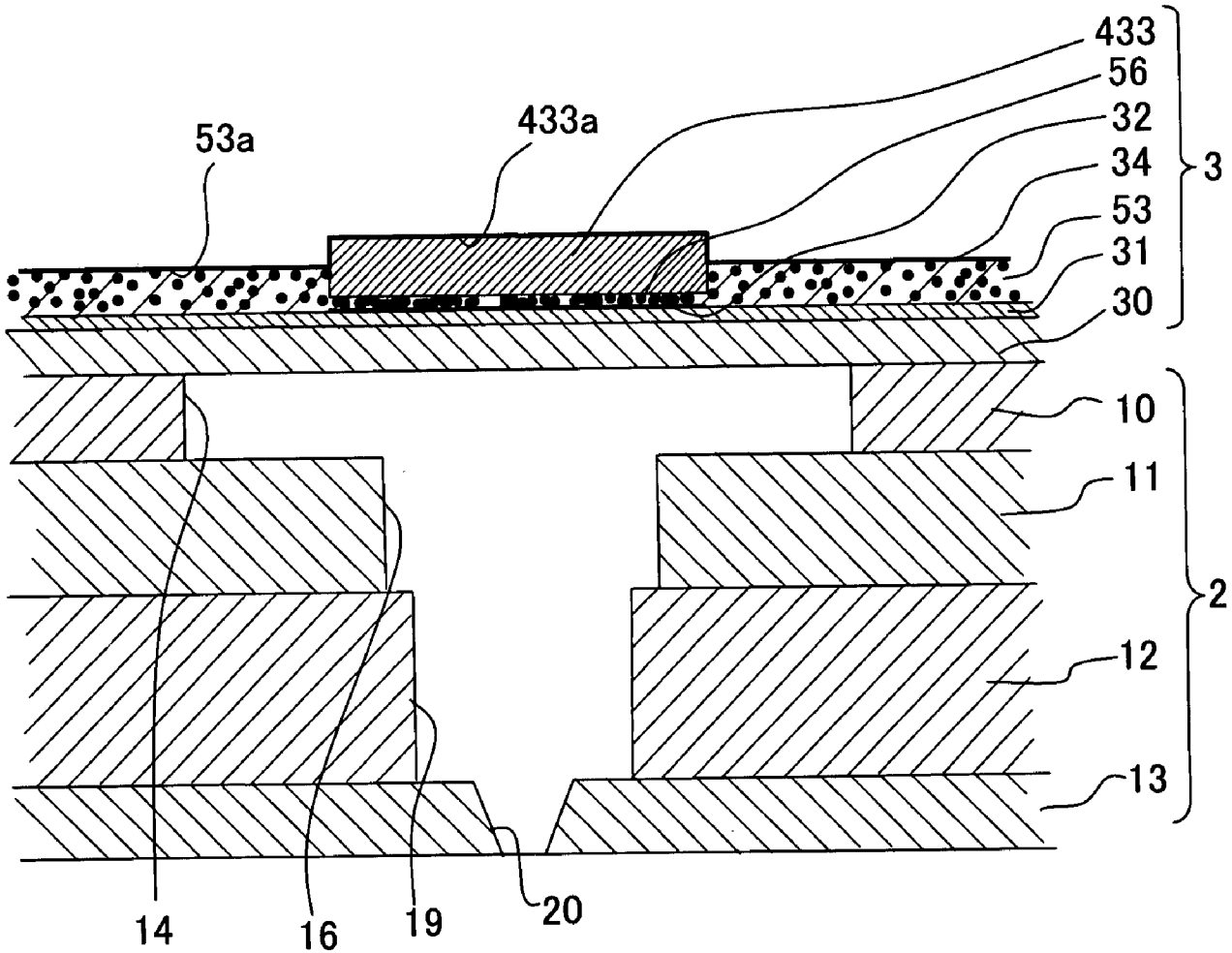
FIG. 11 is a sectional view similar to FIG. 6, being a sectional view of an ink jet head according to a fifth embodiment of the present invention.

A fifth embodiment of the present invention will be described below with reference to FIG. 11. The parts in this embodiment that are identical with the counterparts in the first embodiment will be assigned the same reference numerals and will not be described. FIG. 11 is a sectional view similar to FIG. 6. This embodiment differs in structure from the first embodiment in that an electrode (a third electrode) 56 is formed between each piezoelectric layer 433 and the anisotropic conductive layer 53 of this embodiment. This electrode 56 is formed in advance on the surface of the associated piezoelectric layer 433 that adjoins the anisotropic conductive layer 53, before the piezoelectric layers 433 are transferred onto the anisotropic conductive layer 53 at the piezoelectric layer forming step described in connection with the first embodiment. The electrodes 56 for the piezoelectric layers 433 are formed of a conductive paste on a piezoelectric sheet by the screen printing process, sputtering process, vapor deposition process or another process, before the sheet is cut into pieces of the predetermined size with a laser to form the piezoelectric layers 433. Alternatively, the electrodes 56 might be formed by forming an electrically conductive layer on each surface of each piece of the cut piezoelectric sheet by the plating process, sputtering process, vapor deposition process or another process, and by removing the conductive layers on the surfaces of the pieces of the piezoelectric sheet that are out of contact with the anisotropic conductive layer 53 by means of a laser, a mask, the resist process or the like. An electric field can be generated reliably across each piezoelectric layer 433 through the associated electrode 56.

Sixth Embodiment

Figure 12:
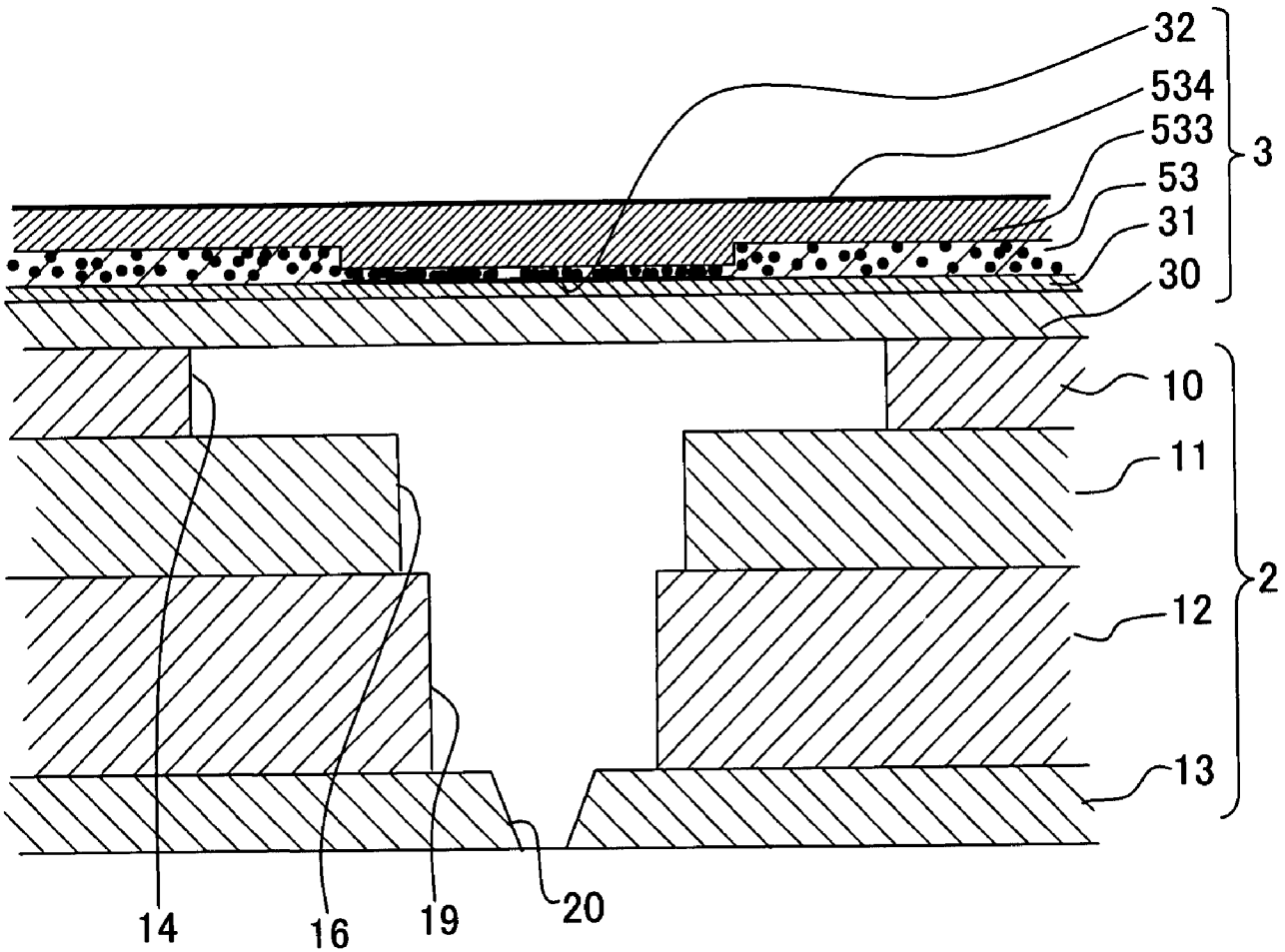
FIG. 12 is a sectional view similar to FIG. 6, being a sectional view of an ink jet head according to a sixth embodiment of the present invention.

A sixth embodiment of the present invention will be described below with reference to FIG. 12. The parts in this embodiment that are identical with the counterparts in the first embodiment will be assigned the same reference numerals and will not be described. FIG. 12 is a sectional view similar to FIG. 6. This embodiment differs in structure from the first embodiment in having a continuous piezoelectric layer 533, which is formed on the upper surface of the anisotropic conductive layer 53 over the pressure chambers 14. The portions of the piezoelectric layer 533 that lie over the individual electrodes 32 are thicker than the remaining portion of this layer. A common electrode 534 is formed without differences in level on the upper surface of the piezoelectric layer 533.

The piezoelectric layer 533 is formed by burning a piezoelectric sheet having portions thicker than the remaining portion. The thicknesses of the thicker portions of the piezoelectric layer 533, each of which lies over the associated individual electrode 32, and the thinner portion of this layer are so adjusted that, when the thinner portion comes into contact with the anisotropic conductive layer 53, the thicker portions compress the anisotropic conductive layer 53 sufficiently. The common electrode 534 might be formed at the first electrode forming step described in connection with the first embodiment. In this embodiment, however, the piezoelectric layer forming step is followed by the additional step of forming the common electrode 534 on the flat side of the piezoelectric layer 533, so the first electrode forming step can be omitted. When the piezoelectric layer 533 is pressed at the compression step described in connection with the first embodiment, its thicker portions compress portions of the anisotropic conductive layer 53. The compressed portions are electrically conductive. In the meantime, the thinner portion of the piezoelectric layer 533 comes into contact with the remaining portion of the anisotropic conductive layer 53, without compressing it. This portion of the anisotropic conductive layer 53 remains electrically insulative. Accordingly, as is the case with the first embodiment, the potential difference between each of the individual electrodes 32 to which drive voltage is applied and the common electrode 534 deforms the associated thicker portion of the piezoelectric layer 533, which lies over the associated individual electrode 32. In the thinner portion of the piezoelectric layer 533, which does not lie over the individual electrodes 32, the generation of parasitic capacitance between the common electrode 534 and each of the wires 35, which extend on the insulating layer 31, is inhibited. The anisotropic conductive layer 53, which is insulative and interposed between the common electrode 534 and wires 35, prevents them from short-circuiting. Because the anisotropic conductive layer 53, which is insulative, is interposed between the common electrode 534 and individual electrodes 32, the thinner portion of the piezoelectric layer 533 does not deform, so that it is possible to reduce the crosstalk that occurs in the thicker portions of this layer, which lie over the individual electrodes 32. Because the common electrode 534 has no difference in level, it can be formed easily. The other aspects of the structure, operation and effect of this embodiment are the same as those of the first embodiment and will not be described.

Alternatively, the piezoelectric layer 533 might be a flat plate. In this case, only the portions of the piezoelectric layer 533 each of which lies over one of the pressure chambers 14 might be heated and pressed. As a result, the portions of the anisotropic conductive layer 53 each of which lies over one of the pressure chambers 14 is compressed to be conductive, and the remaining portion of this layer is not compressed but remains insulative. In other words, the piezoelectric layer 533 might be deformed partially in the form of recesses or depressions, so that only the portions of this layer each of which lies over one of the pressure chambers 14 could be deformed by drive voltage.

Seventh Embodiment

Figure 13:
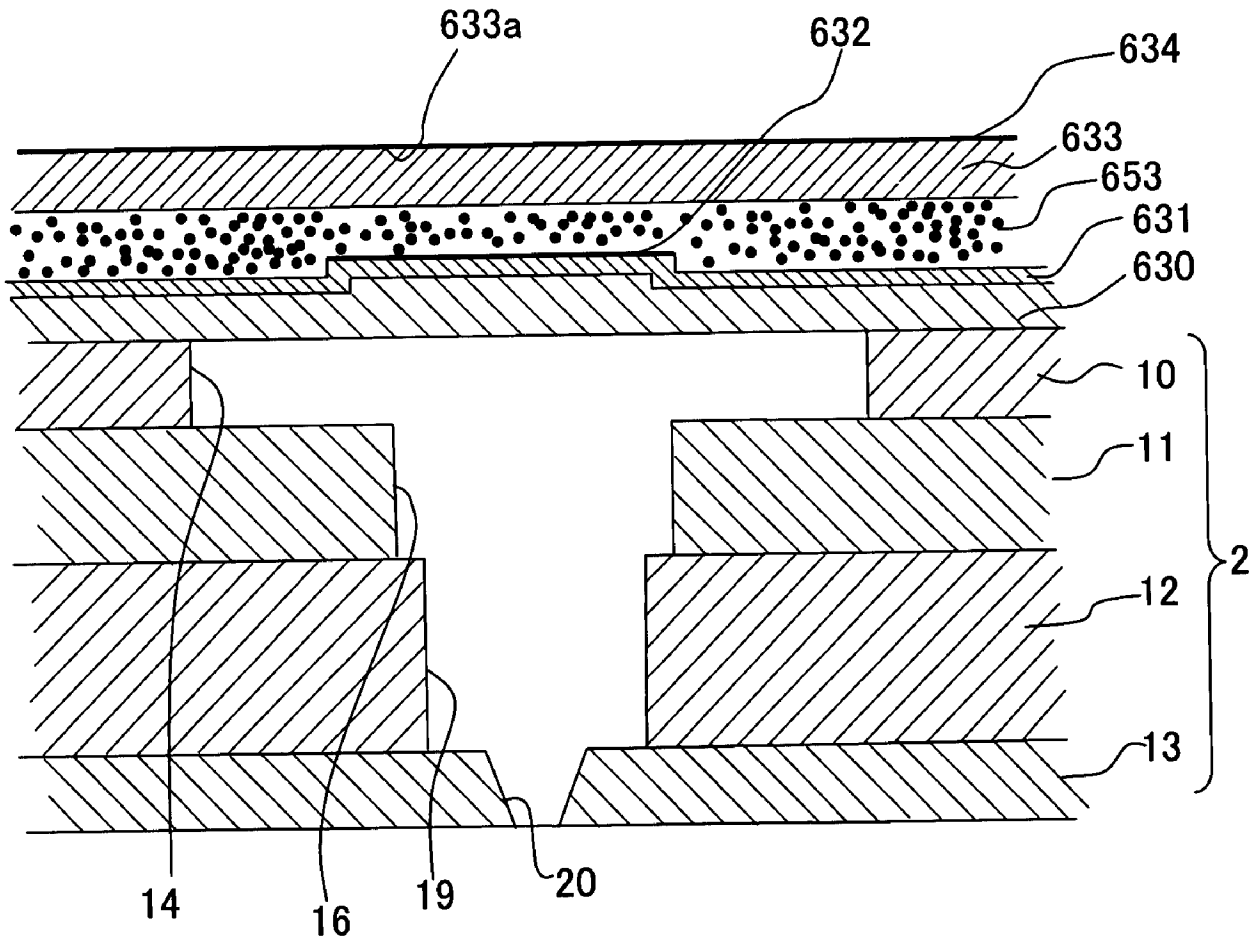
FIG. 13 is a sectional view similar to FIG. 6, being a sectional view of an ink jet head according to a seventh embodiment of the present invention.

A seventh embodiment of the present invention will be described below with reference to FIG. 13. The vibration plate 630 of this embodiment has thicker portions that are rectangular in section. Each of the thicker portions is formed under an individual electrode 632. The piezoelectric layer of the sixth embodiment has thicker portions. This embodiment is similar to the sixth embodiment, except that the vibration plate 630 has thicker portions, and that the piezoelectric layer 633 of this embodiment is flat.

The portions of the vibration plate 630 that lie under the individual electrodes 632 are thicker than the remaining portion of the vibration plate. Accordingly, at the compression step, the portions of the anisotropic conductive layer 653 that lie over the thicker portions of the vibration plate 630 are compressed sufficiently to be conductive. In the meantime, the portion of the anisotropic conductive layer 653 that lies over the remaining portion of the vibration plate 630 is not compressed strongly but remains insulative. The thicker portions of the vibration plate 630 are high enough that, when the anisotropic conductive layer 653 is heated and pressed, only its portions lying over the thicker portions are compressed sufficiently to be conductive.

In this embodiment, a pressing plate is used to press the upper surface 633*a* of the piezoelectric layer 633 toward the insulating layer 631 so as to apply pressure on the anisotropic conductive layer 653. Alternatively, pressure might be applied on the interior of the pressure chambers 14 so as to curve the vibration plate 630 toward the piezoelectric layer 633, thereby pressing the anisotropic conductive layer 653. The pressure chambers 14 might be filled with gas or liquid, and pressure might be applied on the gas or liquid in them so as to exert pressure on their interior. In this case, also, the thicker portions of the vibration plate 630 are high enough that, when the anisotropic conductive layer 653 is pressed, only its portions lying over the thicker portions are compressed sufficiently to be conductive.

Eighth Embodiment

Figure 14:
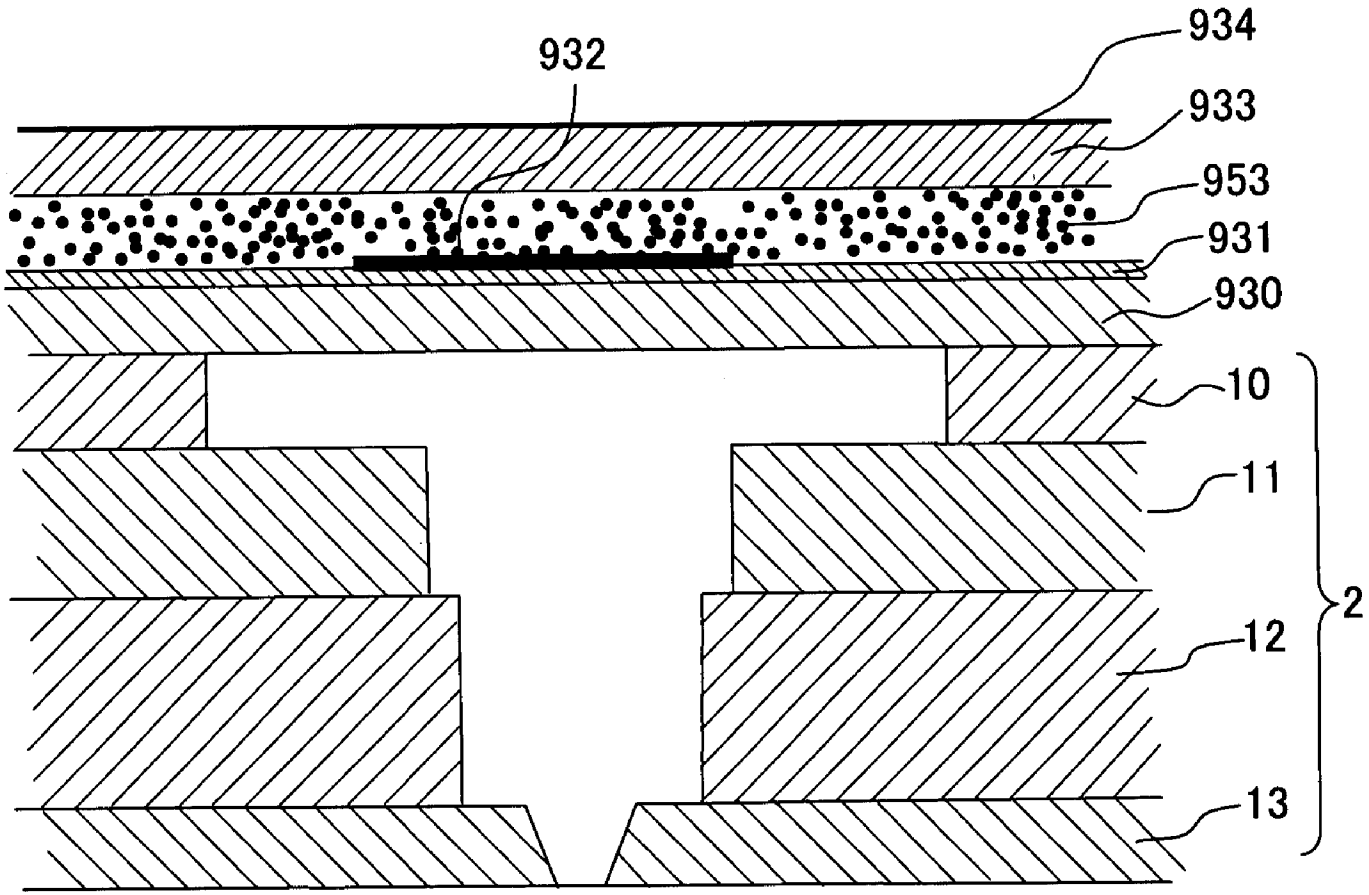
FIG. 14 is a sectional view similar to FIG. 6, being a sectional view of an ink jet head according to an eighth embodiment of the present invention.

As shown in FIG. 14, the individual electrodes 932 of an eighth embodiment of the present invention are very thick. This embodiment is similar to the sixth embodiment, except that the individual electrodes 932 are very thick, and that the piezoelectric layer 933 of this embodiment is flat.

The thick individual electrodes 932 make it possible to press only the portions of the anisotropic conductive layer 953 each of which lies on one of them. The piezoelectric layer 933 and vibration plate 930 of this embodiment do not need to have thicker portions as formed in the sixth and seventh embodiments. Because the piezoelectric layer 933 and vibration plate 930 are flat and continuous, they can be produced at low cost. Because the piezoelectric layer 933 and vibration plate 930 are flat, the steps of forming the common electrode 934 and insulating layer 931 of this embodiment are easy. In general, the individual electrodes have a thickness of about 0.8 micrometer. If the individual electrodes have a thickness of 1 or more micrometers, particularly of 2 or more micrometers, there is as much effect as in a case where the piezoelectric layer or the vibration plate has thicker portions.

Ninth Embodiment

Figure 15:
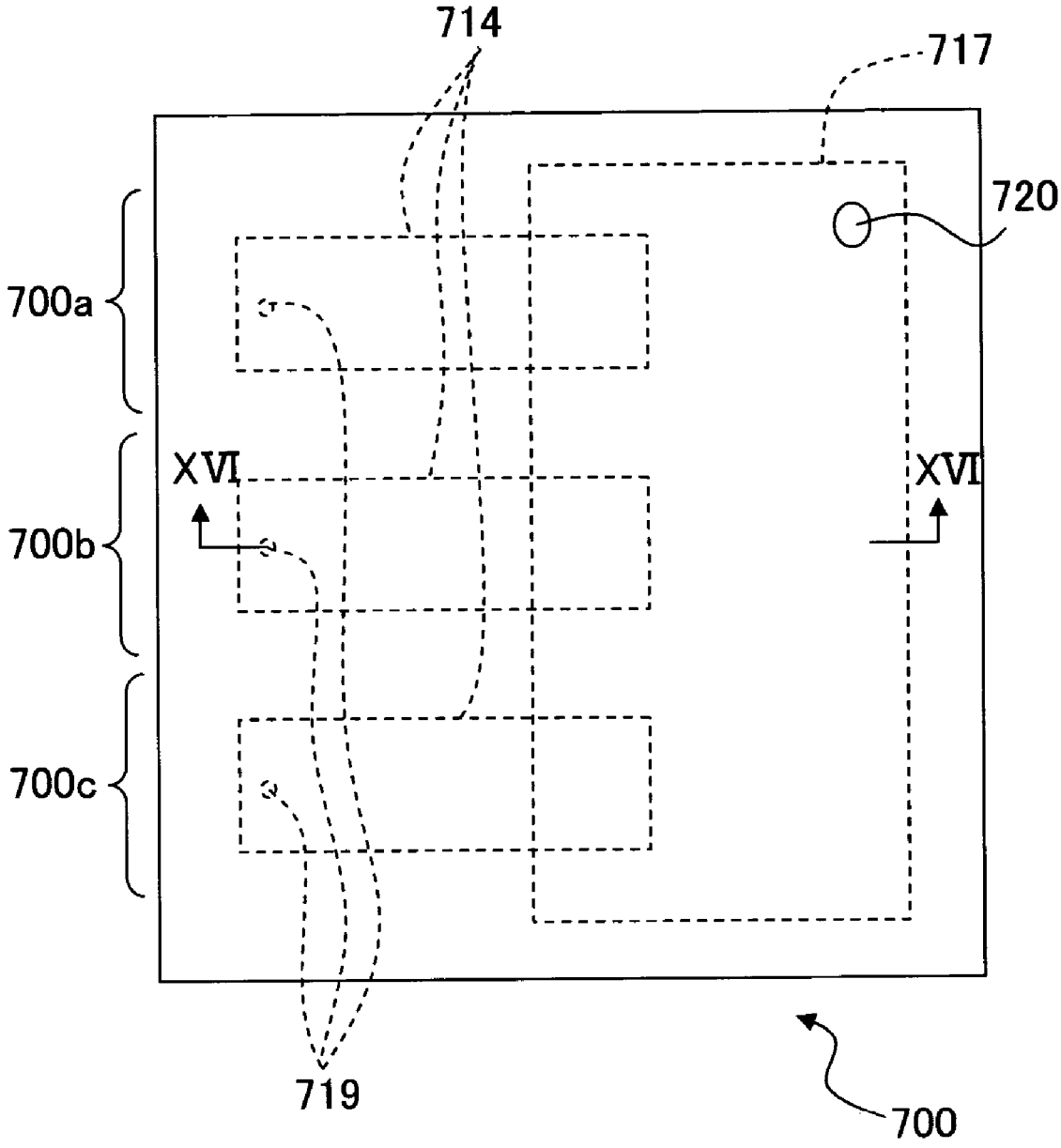
FIG. 15 is a plan view of a liquid transport device according to a ninth embodiment of the present invention.
Figure 16:
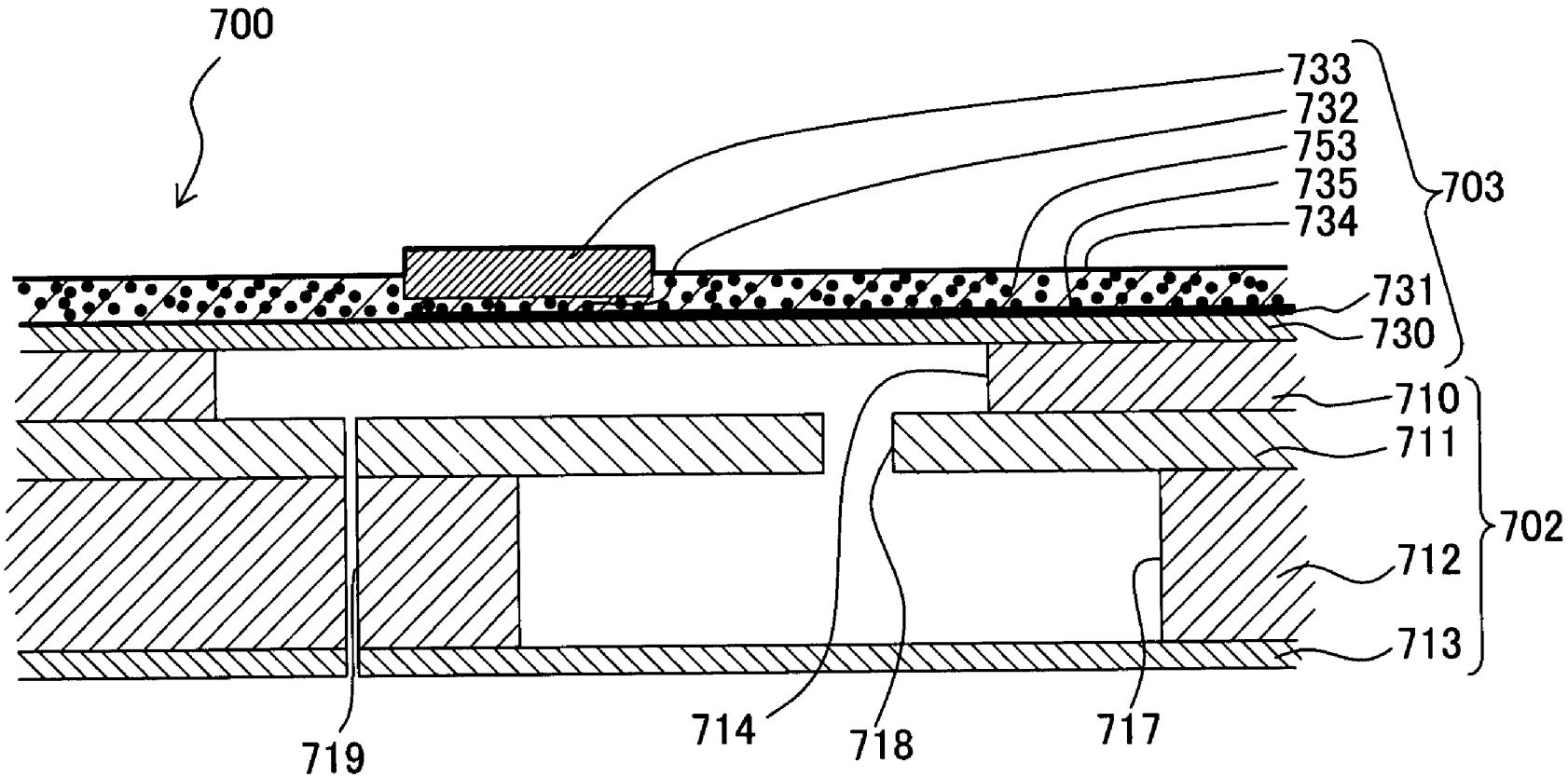
FIG. 16 is a sectional view taken along line XVI-XVI of FIG. 15, being a sectional view of the liquid transport device according to the ninth embodiment.

FIGS. 15 and 16 show a liquid transport device 700 according to a ninth embodiment of the present invention. As shown in FIG. 15, the liquid transport device 700 includes three liquid transport units 700*a*-700*c*, which are identical in structure and connected together in parallel via a common manifold 717. The manifold 717 communicates with a liquid supply port 720, which is formed through a cavity plate 710.

As shown in FIG. 16, the liquid transport unit 700*b* has a channel unit 702 and a piezoelectric actuator 703. The channel unit 702 has a cavity plate 710, a first base plate 711, a manifold plate 712 and a second base plate 713, all of which are metallic. A piezoelectric actuator 703 lies on the channel unit 702, which are formed by laminating the four metallic plates 710-713. The piezoelectric actuator 703 has a vibration plate 730, individual electrodes 732, wires 735, piezoelectric layers 733, an anisotropic conductive layer 753 and a common electrode 734. The vibration plate 730 is metallic, and an insulating layer 731 is formed on its one surface. Each individual electrode 732 is formed over a pressure chamber 714. The common electrode 734 lies on the upper surface of the anisotropic conductive layer 753.

The pressure chambers 714 are rectangular holes formed through the cavity plate 710. The manifold 717 is a rectangular hole formed through the manifold plate 712. The first base plate 711 has communicating holes 718 formed through it, each of which connects one of the pressure chambers 714 to the manifold 717. The first base plate 711, manifold plate 712 and second base plate 713 have discharge channels 719 formed through them, each of which extends between one of the pressure chambers 714 and the lower surface of the second base plate 713.

A method for producing the liquid transport device 700 will be described below. First, the plates of the channel unit 702 are laminated in the order shown in FIG. 16. Then, the metallic vibration plate 730 is laminated on the top side of the channel unit 702. The laminated metallic plates are joined together by means of diffused junction. Subsequently, the insulating layer 731 is formed on the upper surface of the vibration plate 730 by the aerosol deposition process, which has been described in connection with the first embodiment.

The individual electrodes 732 and wires 735 are formed on the upper surface of the insulating layer 731 by the screen printing process. Each individual electrode 732 is positioned over the associated pressure chamber 714 and connected electrically to one of the wires 735, which are connected electrically to a driver IC (not shown).

The anisotropic conductive layer 753 is formed on the upper surface of the insulating layer 731, on which the individual electrodes 732 and wires 735 lie. The piezoelectric layers 733 are formed by cutting a burned green sheet into pieces of a predetermined size with a laser. The piezoelectric layers 733 are positioned on the upper surface of the anisotropic conductive layer 753, each over one of the individual electrodes 732. Subsequently, while the piezoelectric layers 733 are pressed, they are heated so that the anisotropic conductive layer 753 is hardened. When the anisotropic conductive layer 753 is hardened, its pressed portions, each of which lies between one of the piezoelectric layers 733 and the associated individual electrode 732, are electrically conductive, and its remaining portion remains electrically insulative.

Finally, the common electrode 734 and a wire 741 are formed on the upper surfaces of the piezoelectric layers 733 and anisotropic conductive layer 753 by the screen printing process. The common electrode 734 lies over all of the piezoelectric layers 733. The wire 741 connects the common electrode 734 electrically to the driver IC (not shown), through which this electrode is grounded so that its potential is kept at ground potential.

The operation of the liquid transport device 700 will be described below. Before the operation of the liquid transport device 700, all of the channel units 702 of the three liquid transport units 700*a*-700*c* are filled with liquid. The liquid supply port 720 is connected to a liquid tank (not shown), from which the channel units 702 can be supplied constantly with liquid.

Voltage can be applied through the driver IC (not shown) to the individual electrodes 732, each of which lies under the associated piezoelectric layer 733. The voltage application generates an electric field vertically across each piezoelectric layer 733, so that the piezoelectric layers 733 contract horizontally (right and left in FIG. 16). The insulating layer 731 and vibration plate 730, which lie under the piezoelectric layers 733, are fixed to the cavity plate 710. Accordingly, each contracting piezoelectric layer 733, which lies between the associated individual electrode 732 and the common electrode 734, deforms convexly toward the associated pressure chamber 714. As a result of the deformation of each piezoelectric layer 733, the portion of the vibration plate 730 that covers the associated pressure chamber 714 deforms convexly into this chamber. This reduces the volume of the pressure chamber 714, raising the pressure of the liquid in it, so that part of the liquid is discharged through the discharge channel 719 communicating with it.

When the voltage application to each individual electrode 732 stops, the associated piezoelectric layer 733 and the vibration plate 730 are restored to their original shapes, so that the internal pressure in the associated pressure chamber 714 decreases. The discharge channels 719 are much smaller in diameter and lower in conductance than the communicating holes 718. Accordingly, the liquid flowing into each pressure chamber 714 restored to its original volume is supplied from the manifold 717 through the associated communicating hole 718. The manifold 717 is supplied constantly with liquid through the liquid supply port 720, so that the manifold 717, communicating holes 718 and pressure chambers 714 are filled constantly with liquid. Consequently, the liquid transport device 700 can transfer liquid from the manifold 717 through the discharge channels 719 to the outside of the device.

The individual electrodes 732, common electrode 734 and wire 741 may be formed by the vapor deposition process or the sputtering process. The insulating layer 731 may be formed by the sol-gel process, the sputtering process or the CVD process. It is essential that the voltage for application to the individual electrodes 732 should vary with time. The parameters such as the magnitude and frequency of the waveform of the voltage may be set arbitrarily.

Tenth Embodiment

A liquid transport device according to a tenth embodiment of the present invention can separately transport different types of liquid.

Figure 17:
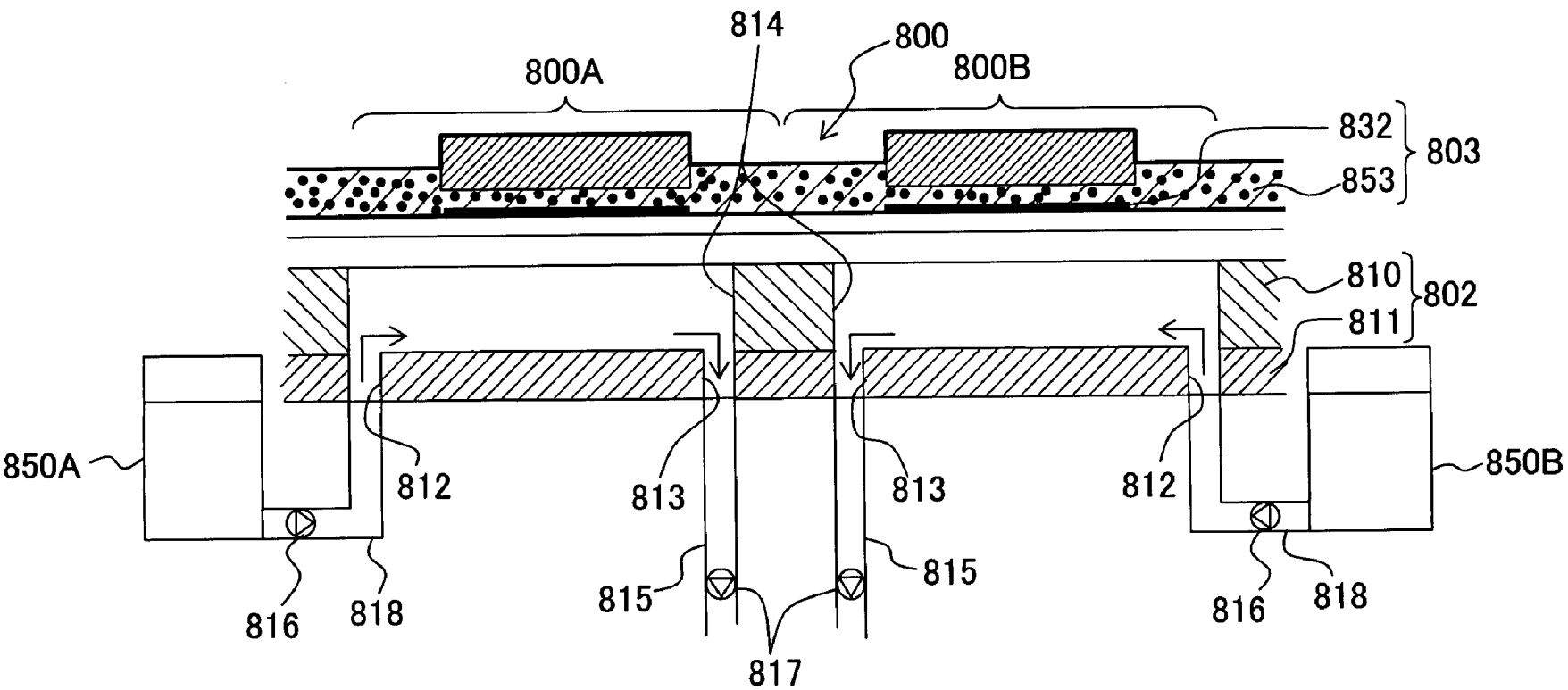
FIG. 17 is a sectional view of a liquid transport device according to a tenth embodiment of the present invention.

As shown in FIG. 17, the liquid transport device 800 according to this embodiment includes a first transport section 800A and a second transport section 800B, which are identical in structure, and each of which has a piezoelectric actuator 803 and a channel unit 802.

The channel unit 802 has a cavity plate 810 and a base plate 811. The cavity plate 810 has a rectangular hole formed through it as a pressure chamber 814. The base plate 811 has an inlet channel 812 and an outlet channel 813, both of which communicate with the pressure chamber 814.

One end of a flexible inlet tube 814 is connected to the inlet channel 812 of each of the transport sections 800A and 800B. One end of a flexible outlet tube 815 is connected to the outlet channel 813 of each of the transport sections 800A and 800B. The other ends of the inlet tubes 818 of the transport sections 800A and 800B are connected to liquid tanks 850A and 850B, respectively. The other end of the outlet tube 815 of each of the transport sections 800A and 800B is connected to a place (not shown) to which liquid can be discharged. The tubes 818 and 815 are fitted with check valves 816 and 817, respectively.

The piezoelectric actuator 803, which lies on the top side of the channel unit 802, is similar in structure to that of the ninth embodiment and produced with an anisotropic conductive layer 853 by a method similar to that for the ninth embodiment.

After the liquid tanks 850A and 850B are supplied with liquid to be transported, the liquid transport device 800 operates to apply pulsed voltage continuously to the individual electrodes 832 through a driver IC (not shown). As described in connection with the eighth embodiment, it is possible to change the pressure in the pressure chambers 814 by applying to the individual electrodes 832 a voltage varying with time. Accordingly, the pressure chambers 814 can serve as pumps and can transport the liquid in the tanks 850A and 850B toward the outlet channels 813. The check valves 816 and 817 in the inlet and outlet tubes 818 and 815, respectively, prevent the back flow of liquid, so that the liquid transport device 800 can operate stably.

The transport sections 800A and 800B are independent of each other and connected to the liquid tanks 850A and 850B, respectively. Accordingly, the transport sections 800A and 800B can systematically and selectively transport two types of liquid, such as liquids different in color or composition. The liquid tanks 850A and 850B, check valves 816 and 817, inlet tubes 818 and outlet tubes 815 may be part of the equipment or facilities at the site where the liquid transport device 800 is used. Therefore, the liquid tanks 850A and 850B, check valves 816 and 817, inlet tubes 818 and outlet tubes 815 are not essential to the liquid transport device 800.

The liquid transport device according to each of the ninth and tenth embodiment includes a plurality of transport sections. The number of transport sections is not limited to two or three, but may be four or larger. The transport sections might be connected in series and/or parallel in the liquid transport devices.

Each of the liquid transport devices according to the present invention is simple in structure and can transport liquid selectively through a plurality of liquid discharge ports, without causing crosstalk between adjacent pressure chambers. In each of the liquid transport devices, the individual electrodes and the wires are formed on the insulating layer, which lies on the vibration plate. The individual electrodes and the wires have no movable portion, and accordingly there is less possibility of their breaking. Because the individual electrodes and the wires are formed by the screen printing process, vapor deposition process or sputtering process, it is possible to space the wires, the electrodes, etc. very densely. Because the individual electrodes and the wires are covered with the anisotropic conductive layer so as not to be touched directly, they are high in electric connection reliability. Because the portion of the anisotropic conductive layer that is out of contact with the individual electrodes is an insulator, the parasitic capacitance between these electrodes and the parasitic capacitance between the wires are so low that no crosstalk occurs.

The liquid transport devices according to the present invention can be used as unit modules for circulating cooling water through the cooling channels formed in electric circuit boards. The liquid transport devices can also be used as very small pumps. One of the pumps is a micro pump fitted to the front end of an endoscope. This micro pump operates to coat an affected internal part of the human body with different liquid medicines. Another of the pumps is a micro pump for supplying an internal part of a patient's body with different medicines in preset amounts and according to a preset time schedule.

The present invention is not limited to the preferred embodiments described hereinbefore, which may be modified without departing from the spirit of the invention. For example, the individual electrodes 32 might not be essential, but might be omitted. Each piezoelectric layer 33 compresses the portion of the anisotropic conductive layer 53 that lies between it and the insulating layer 31. The conductive particles in the compressed portions of the anisotropic conductive layer 53 make the whole compressed portions conductive. Accordingly, the compressed portion of the anisotropic conductive layer 53 that lies under each piezoelectric layer 33 could function as an individual electrode 32. In this case, it would be necessary that the end of each wire 35 that is opposite to the associated terminal 36 be positioned over the associated pressure chamber 14 and so positioned as to be connectable to the associated compressed portion of the anisotropic conductive layer 53, which could function as an individual electrode 32.

In each of the embodiments, the plate material for the channel unit and vibration plate might not be limited to stainless steel, but might be plates of metal such as copper or aluminum, or of non-metal such as synthetic resin. In each of the embodiments, pressure is applied in the specific direction on the anisotropic conductive layer. The pressure might be applied in the direction from the piezoelectric layers or layer to the pressure chambers. Alternatively, the pressure might be applied in the opposite direction from the pressure chambers to the piezoelectric layers or layer by raising the pressure in the pressure chambers.

What is claimed is:

1. A liquid transport device comprising:

a channel unit having a plurality of pressure chambers arranged on a plane and a plurality of discharge ports for liquid each communicating with one of the pressure chambers; and a piezoelectric actuator which changes a volume of the pressure chambers, and is arranged on a surface of the channel unit, the piezoelectric actuator having a vibration plate insulative on at least one side thereof, wires which are disposed on the one side of the vibration plate, and each of which extends from a position facing one of the pressure chambers, an anisotropic conductive layer formed on the one side of the vibration plate continuously over the pressure chambers to cover the wires disposed on the one side of the vibration plate, the anisotropic conductive layer being compressed to be conductive in first regions each facing one of the pressure chambers while being insulative in a second region facing none of the pressure chambers, a piezoelectric layer formed on a side of the anisotropic conductive layer which is opposite to a vibration plate, and a first electrode formed continuously over the pressure chambers on a side of the piezoelectric layer which is opposite to the anisotropic conductive layer.

2. The liquid transport device according to claim 1, which is an ink jet head, the liquid being ink, the discharge ports being nozzles through which the ink is discharged.

3. The liquid transport device according to claim 2, wherein the piezoelectric actuator further has second electrodes which are formed on the one side of the vibration plate to be connected to respective wires, and each of which is disposed at a position facing one of the pressure chambers.

4. The liquid transport device according to claim 2, wherein the piezoelectric actuator further has third electrodes which are formed between the piezoelectric layer and the anisotropic conductive layer, and each of which is disposed at one of the first regions.

5. The liquid transport device according to claim 2, wherein the piezoelectric actuator further has connecting terminals which are to be connected to a drive unit for supplying drive voltage to compressed conductive portions of anisotropic conductive layer and are formed on the one side of the vibration plate, and each of which is being formed at an end of one of the wires.

6. The liquid transport device according to claim 2, wherein the piezoelectric layer includes isolated piezoelectric portions, and the piezoelectric portions are formed only in the first regions.

7. The liquid transport device according to claim 2, wherein the piezoelectric layer is thicker in the first regions than in the second region.

8. The liquid transport device according to claim 2, wherein the vibration plate is thicker in the first regions than in the second region.

9. The liquid transport device according to claim 2, wherein a sectional shape of the piezoelectric layer which is perpendicular to a plane thereof is trapezoidal which becomes wider toward the vibration plate.

10. The liquid transport device according to claim 2, wherein the piezoelectric layer has an overhang hanging on the side thereof opposite to the vibration plate in parallel with the plane of the piezoelectric layer.

11. An ink jet printer comprising:

a liquid transport device which is an ink jet head, the liquid transport device including a channel unit having a plurality of pressure chambers arranged on a plane and a plurality of nozzles for ink each communicating with one of the pressure chambers; and a piezoelectric actuator which changes a volume of the pressure chambers, and is arranged on a surface of the channel unit, the piezoelectric actuator having a vibration plate insulative on at least one side thereof, wires which are disposed on the one side of the vibration plate, and each of which extends from a position facing one of the pressure chambers, an anisotropic conductive layer formed on the one side of the vibration plate continuously over the pressure chambers to cover the wires disposed on the one side of the vibration plate, the anisotropic conductive layer being compressed to be conductive in first regions each facing one of the pressure chambers while being insulative in a second region facing none of the pressure chambers, a piezoelectric layer formed on a side of the anisotropic conductive layer which is opposite to a vibration plate, and a first electrode formed continuously over the pressure chambers on a side of the piezoelectric layer which is opposite to the anisotropic conductive layer.

12. The liquid transport device according to claim 1, further comprising a valve which regulates a flow of the liquid through the channel unit.

* * * * *